US006489938B1

(12) United States Patent
Ito

(10) Patent No.: US 6,489,938 B1
(45) Date of Patent: Dec. 3, 2002

(54) MATRIX DISPLAY APPARATUS AND PLASMA ADDRESSED DISPLAY APPARATUS

(75) Inventor: Hiroshi Ito, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/551,574

(22) Filed: Apr. 18, 2000

(30) Foreign Application Priority Data

Apr. 28, 1999 (JP) ..... 11-123169
Mar. 3, 2000 (JP) ..... 2000-058724

(51) Int. Cl.[7] ..... G09G 3/28
(52) U.S. Cl. ..... 345/63; 345/58; 345/60
(58) Field of Search ..... 345/58, 60, 63, 345/67, 78, 205, 208, 210; 315/169.4

(56) References Cited

U.S. PATENT DOCUMENTS 4,896,149 A 1/1990 Buzak et al.
5,461,655 A * 10/1995 Vuylsteke et al. ..... 378/62
5,841,411 A * 11/1998 Francis ..... 345/58
6,025,818 A * 2/2000 Okano ..... 345/63
6,064,356 A * 5/2000 Shigeta ..... 345/63
6,091,398 A * 7/2000 Shigeta ..... 345/149
6,204,833 B1 * 3/2001 Hayashi et al. ..... 345/58
6,304,254 B1 * 10/2001 Johnson et al. ..... 345/204

FOREIGN PATENT DOCUMENTS

JP 1-217396 A 8/1989

* cited by examiner

*Primary Examiner*—Lun-Yi Lao
*Assistant Examiner*—Tom V. Sheng
(74) *Attorney, Agent, or Firm*—Nixon & Vanderhye P.C.

(57) ABSTRACT

In a plasma addressed display apparatus, a given first pixel of a plurality of pixels belongs to one of a plurality of row groups each having a plurality of continuous rows. A signal generation supply circuit receives video data and corrects first video data to be displayed by the first pixel based on a predetermined correction function that includes as variables the first video data and second video data to be displayed by a second pixel belonging to a same row group and a same column as the first pixel and belonging to a row different from the first pixel. In certain embodiments, the first and second pixels are in the same plasma discharge channel so that the first video data is corrected based upon variables relating only to pixel(s) in the same plasma discharge channel in which the first pixel is located.

25 Claims, 31 Drawing Sheets

FIG. 1B

| | | n COLUMN | n+1 COLUMN |
|---|---|---|---|
| RG | m ROW | Pix(m, n)<br>Data(m, n) | Pix(m, n+1)<br>Data(m, n+1) |
| | m+1 ROW | Pix(m+1, n)<br>Data(m+1, n) | Pix(m+1, n+1)<br>Data(m-1, n+1) |
| RG | m+2 ROW | Pix(m+2, n)<br>Data(m-2, n) | Pix(m+2, n+1)<br>Data(m-2, n+1) |
| | m+3 ROW | Pix(m+3, n)<br>Data(m+3, n) | Pix(m+3, n+1)<br>Data(m+3, n+1) |

FIG. 1C

| | | n COLUMN | n+1 COLUMN |
|---|---|---|---|
| | m ROW | Pix(m, n)<br>Data(m, n) | Pix(m, n+1)<br>Data(m, n+1) |
| RG | m+1 ROW | Pix(m-1, n)<br>Data(m+1, n) | Pix(m+1, n+1)<br>Data(m-1, n+1) |
| | m+2 ROW | Pix(m-2, n)<br>Data(m-2, n) | Pix(m+2, n+1)<br>Data(m+2, n+1) |
| | m+3 ROW | Pix(m-3, n)<br>Data(m-3, n) | Pix(m+3, n+1)<br>Data(m+3, n-1) |
| RG | m+4 ROW | Pix(m+4, n)<br>Data(m+4, n) | Pix(m+4, n+1)<br>Data(m+4, n+1) |
| | m+5 ROW | Pix(m+5, n)<br>Data(m+5, n) | Pix(m+5, n+1)<br>Data(m+5, n+1) |

FIG. 1D

| | n COLUMN | n+1 COLUMN | n+2 COLUMN | n+3 COLUMN |
|---|---|---|---|---|
| m ROW | Pix(m, n) | Pix(m, n+1) | Pix(m, n+2) | Pix(m, n+3) |
| | Data(m, n) | Data(m, n+1) | Data(m, n+2) | Data(m, n+3) |
| m+1 ROW | Pix(m+1, n) | Pix(m+1, n+1) | Pix(m+1, n+2) | Pix(m+1, n+3) |
| | Data(m+1, n) | Data(m+1, n+1) | Data(m+1, n+2) | Data(m+1, n+3) |
| m+2 ROW | Pix(m+2, n) | Pix(m+2, n+1) | Pix(m+2, n+2) | Pix(m+2, n+3) |
| | Data(m+2, n) | Data(m+2, n+1) | Data(m+2, n+2) | Data(m+2, n+3) |
| m+3 ROW | Pix(m+3, n) | Pix(m+3, n+1) | Pix(m+3, n+2) | Pix(m+3, n+3) |
| | Data(m+3, n) | Data(m+3, n+1) | Data(m+3, n+2) | Data(m+3, n+3) |

RG

RG

VIDEO LEVEL
TIME

PIXEL u1
LEVEL 50
1 SCANNING
PERIOD
PIXEL u2
LEVEL 50
PIXEL u3
LEVEL 50
PIXEL u4
LEVEL 50
PIXEL u5
LEVEL150
PIXEL u6
LEVEL150
PIXEL u7
LEVEL150
PIXEL u8
LEVEL150

PIXEL u1
LEVEL 50
1 SCANNING
PERIOD
PIXEL u2
LEVEL 50
PIXEL u3
LEVEL 50
PIXEL u4
LEVEL 45
PIXEL u5
LEVEL155
PIXEL u6
LEVEL150
PIXEL u7
LEVEL150
PIXEL u8
LEVEL150

MATRIX DISPLAY APPARATUS AND PLASMA ADDRESSED DISPLAY APPARATUS

BACKGROUND OF THE INVENTION

The present invention relates to a matrix display apparatus, and more particularly, to a plasma addressed display apparatus.

As one type of image display apparatuses, conventionally known is a plasma addressed display apparatus that includes a flat panel essentially composed of a display cell and a plasma cell laminated together and peripheral circuits such as a signal circuit and a vertical scanning circuit. One example of such a conventional plasma addressed display apparatus is described in Japanese Laid-Open Patent Publication No. 1-217396.

FIG. 22 shows a structure of a panel of a conventional plasma addressed display apparatus, which is a flat panel structure essentially composed of a display cell 1 and a plasma cell 2 laminated together with a microsheet 3 therebetween. The plasma cell 2 includes a glass substrate 4 and plasma discharge channels 5 arranged in rows, and generates plasma discharge line-sequentially for effecting scanning. The plasma discharge channels 5 are separated from the adjacent ones by barrier ribs 6 that define spaces arranged in rows. Stripe-shaped anode electrodes (A) 7 and stripe-shaped cathode electrodes (K) 8 are formed on the inner surface of the glass substrate 4 inside the respective plasma discharge channels 5. Ionizable gas is enclosed in the spaces of the respective plasma discharge channels 5.

The display cell 1 includes a liquid crystal layer 10 as a display medium retained between an upper glass substrate 9 and the microsheet 3. Stripe-shaped color filters 12 and stripe-shaped data electrodes (P) 11 are formed on the inner surface of the glass substrate 9 in this order so as to extend in the direction intersecting with the plasma discharge channels 5. Pixels are defined at the respective intersections of the color filters 12 and the data electrodes (P) 11 with the plasma discharge channels 5 forming a shape of matrix.

The operation of the plasma addressed display apparatus shown in FIG. 22 will be described with reference to FIG. 23 that shows a portion of FIG. 22 in more detail. When a discharge pulse is applied, plasma discharge is generated in the plasma discharge channel 5 and the inside of the plasma discharge channel 5 is turned to and maintained at around an anode potential. In an equivalent circuit, a virtual electrode 20 is formed on the surface of the microsheet 3 inside the plasma discharge channel 5 and a switch 21 is turned on. A pulse application circuit 22 is a circuit for applying "video data" between the data electrode 11 and the anode electrode 7. When the pulse application circuit 22 applies video data in synchronization with the generation of plasma discharge, video data is written in the liquid crystal layer 11 of the pixel via the microsheet 3. When the plasma discharge is terminated, the switch 21 is turned off. The plasma discharge channel 5 is put in the floating state, allowing the written video data to be retained in the pixel. The transmittance of the liquid crystal changes depending on the retained video data.

In the plasma addressed display apparatus with the above construction, if higher resolution is intended, the components of the apparatus must be miniaturized both in the horizontal (row) and vertical (column) directions. In the case of enhancing the resolution in the vertical direction, the plasma discharge channels arranged in rows must be narrowed. In order to achieve this, the barrier ribs may be narrowed. However, extremely narrowing the barrier ribs is difficult from the standpoints of the fabrication technology and the mechanical strength. If the pitch of the barrier ribs is reduced while the width of the barrier ribs is kept unchanged, the aperture ratio will lower. Moreover, the viewing angle is narrowed since tilted incident light is blocked by the height of the barrier ribs.

The present inventor, together with other co-researchers, proposed a technique for enhancing the resolution of the plasma addressed display apparatus (Japanese Patent Application No. 10-253145, which, as well as corresponding U.S. patent application Ser. No. 09/391,804 filed on Sep. 8, 1999, are herein incorporated by reference). This technique attempts to enhance the vertical resolution of the plasma addressed display apparatus without changing the width and pitch of the barrier ribs.

FIG. 24 shows a panel structure of a plasma addressed display apparatus proposed by the present inventor and co-researchers described above. The plasma addressed display apparatus of FIG. 24 is different from that of FIG. 22 in that scanning electrodes (S) 13 are used as the electrodes for plasma discharge. The scanning electrodes (S) 13 are disposed at the bottoms of the barrier ribs 6 and at positions between the adjacent barrier ribs 6.

The operation of the plasma addressed display apparatus will be described with reference to FIGS. 25A and 25B. FIG. 25A illustrates the video data write operation of the conventional plasma addressed display apparatus disclosed in the Japanese Laid-Open Patent Publication No. 1-217396 described above, and FIG. 25B illustrates the video data write operation of the high-definition plasma addressed display apparatus proposed by the present inventor and co-researchers (Japanese Patent Application No. 10-253145) employing a conventional drive method.

Referring to FIG. 25A, at timing T11, a discharge pulse is applied to a cathode K1, and video data D11 is written and retained in a plasma discharge channel including the cathode K1 and an anode A1. At timing T12 as the next scanning period, a discharge pulse is applied to a cathode K2, and video data D12 is written and retained in a plasma discharge channel including the cathode K2 and an anode A2. At timing T13 as the subsequent scanning period, video data D13 is written in a similar manner. By this series of processing at timings T11 through T13, predetermined video data are written in predetermined plasma discharge channels as shown under timing T1E. In this case, one piece of video data is written in one plasma discharge channel.

Referring to FIG. 25B, at timing T21, a discharge pulse is applied to a selected scanning electrode S1 to allow plasma discharge to be generated between the selected scanning electrode S1 and the adjacent scanning electrodes, i.e., between S0–S1 and S1–S2, and video data D21 is written and retained in a plasma discharge channel including the selected scanning electrode S1. At timing T22 as the next scanning period, a discharge pulse is applied to a selected scanning electrode S2 to allow plasma discharge to be generated between the selected scanning electrode S2 and the adjacent scanning electrodes, i.e., in regions between S1–S2 and S2–S3 that are located in different plasma discharge channels blocked by the barrier rib 6. Video data D22 is written and retained in these plasma discharge channels. At this time, focusing on the video data written in the region between the scanning electrodes S1 and S2, the video data D21 written at timing T21 is overwritten with the video data D22 at timing T22. Similarly, at timings T23, T24, T25, and T26, a discharge pulse is applied to selected scanning electrodes S3, S4, S5, and S6, and video data D23, D24, D25, and D26 are written and retained. By this series of processing at timings T21 through T26, predetermined video data are written in predetermined plasma discharge channels as shown under timing T2E. In this way, in the plasma addressed display apparatus of FIG. 24, two pieces of video data are written in one plasma discharge channel. This improves the vertical resolution of the plasma addressed display apparatus, compared with the case shown in FIG. 25A, without changing the structure such as the pitch and width of the barrier ribs.

FIG. 26 shows the entire construction of the plasma addressed display apparatus shown in FIG. 24. Referring to FIG. 26, the plasma addressed display apparatus includes a panel 201, a signal circuit 202, a vertical scanning circuit 203, a control circuit 204, an input terminal group 206, a synchronous separation circuit 207, a system microcomputer 208, and a vertical compensation circuit 210.

The panel 201 has a flat panel structure essentially composed of a plasma cell and a display cell laminated together. The plasma cell has scanning electrodes S1 to Sn arranged in rows, and the display cell has data electrodes P1 to Pm. Pixels 205 are defined at respective intersections between the scanning electrodes S1 to Sn and the data electrodes P1 to Pm. The synchronous separation circuit 207 extracts a horizontal synchronous signal and a vertical synchronous signal from video data input via the input terminal group 206, and supplies extracted various timing signals to the control circuit 204 and the system microcomputer 208. The system microcomputer 208 manages the display phase of video data when displayed on the panel 201. The control circuit 204 controls synchronization between the signal circuit 202 and the vertical scanning circuit 203. The vertical scanning circuit 203 applies a discharge pulse to the scanning electrodes S1 to Sn line-sequentially to effect scanning. The signal circuit 202 supplies video data to the data electrodes P1 to Pm in synchronization with the scanning by the vertical scanning circuit 203. The vertical compensation circuit 210 compensates a vertical high frequency component of the video data.

FIG. 27 is a block diagram of the vertical compensation circuit 210 shown in FIG. 26. FIGS. 28A and 28B are diagrammatic illustrations of the operation of the vertical compensation circuit 210. Referring to FIG. 27, the vertical compensation circuit 210 delays a signal by a scanning period unit using line memories 32 and 33. Signals obtained from the line memories 32 and 33 are subjected to various operations and then gain-adjusted by a gain circuit 39. The resultant value is added to a current signal W2 by an adder 40.

The operation of the vertical compensation circuit 210 of FIG. 27 will be described with reference to FIGS. 28A and 28B. FIG. 28A represents the state where pixels u1 to u4 having a video level 50 and pixels u5 to u8 having a video level 150 are lined in the stream of scanning periods. Assume that the pixel u4 having a video level 50 corresponds to a current signal, i.e., the pixel u4 is a focusing pixel. In this case, the signal W2 in FIG. 27 corresponds to u4, while signals W1 and W3 correspond to the pixel u5 having a video level 150 and the pixel u3 having a video level 50, respectively.

Signals obtained from the line memories 32 and 33 are multiplied by −¼ by multipliers 34 and 36 and by ½ by a multiplier 35. The results from the multipliers 34, 35, and 36 are summed by adders 37 and 38. An output W4 from the adder 38 is −25. An optimal operational value used by the gain circuit 39 is not uniquely determined but varies depending on the preference of the viewer of the plasma addressed display apparatus. In many cases, however, a value between 0 and 1 is used. Assuming that the operational value is ⅕ in this case, an output W5 from the gain circuit 39 is −5. An adder 40 adds the value W5 to the current signal W2. As a result, an output W6 is 45. Similarly, when the pixel u5 corresponds to a current signal, the output W6 becomes 155 as a result of the operations with the preceding and subsequent signals. If the focusing pixel has the same video level as the adjacent pixels, such as the pixel u6, having no discernable change in the image from adjacent pixels, the output W6 is 150 indicating that no compensation is made.

FIG. 28B represents the results of the compensation made for the video data by the vertical compensation circuit 210. As is apparent from FIG. 28B, a compensating signal has been added to the original signal at the edge portion of an image where the pixel level shifts, such as the portion between the pixels u4 and u5, thereby emphasizing the edge portion.

The conventional high-definition plasma addressed display apparatus shown in FIG. 24 proposed by the present inventor and co-researchers has a problem of generating a phenomenon that video data within one plasma discharge channel interfere with each other. For example, at timing T2E in FIG. 25B, the video data D21 and D22, as well as the video data D23 and D24, interfere with each other. This is due to absence of a barrier rib therebetween.

The interference between video data in the plasma addressed display apparatus of FIG. 24 will be described with reference to FIGS. 29A and 29B. FIGS. 29A and 29B are diagrammatic illustrations of the display states of video data displayed on the plasma addressed display apparatus of FIG. 24, specifically showing the state where a black line such as a part of a letter is displayed on a white background in a region of eight scanning lines (L1 to L8) and ten pixels (X1 to X10). FIG. 29A shows the state intended to write and display video data. Video data in one plasma discharge channel influence each other in the vertical direction due to absence of a barrier rib therebetween as described above. That is, the brightness for white video data tends to decrease, becoming dark, and in reverse, the brightness for black video data tends to increase. As a result, as shown in FIG. 29B, two pixels, one is black and the other is white, in the same plasma discharge channel, for example, the pixel at the crossing (L5, X6) and the pixel at the crossing (L6, X6), interfere with each other, changing the original video data. This results in quality degradation of the resultant display image such as lowered sharpness and smear at edges, which may cause the viewer to feel uncomfortable.

The vertical compensation circuit 210 is unable to minimize the above disturbance due to the interference. Rather, the compensation of a vertical edge signal tends to facilitate the disturbance, making the disturbance more conspicuous. In other words, it is not possible to use a sufficiently large gain for the vertical compensation for fear of influence of the interference.

The above problem does not only arise in the plasma addressed display apparatus exemplified above, but also may arise in other line-sequential drive type matrix display apparatuses. In such a line-sequential drive type, pixels are electrically addressed independently and the display states of the pixels are electrically retained. This may cause electrical interference between rows or columns (interference between video data). Such interference is particularly significant in matrix display apparatuses employing an addressing method that makes the interference between video data especially eminent between specific rows (between continuous scanning units), such as the plasma addressed display apparatus described above.

SUMMARY OF THE INVENTION

An object of the present invention is providing matrix display apparatus and a plasma addressed display apparatus capable of minimizing interference between video data.

In relation to the above object, the present invention is in particular aimed at obtaining high-definition, high-quality images without blur or smear by detecting the degree of disturbance due to interference from the amplitudes of video data adjacent in the vertical direction in the same discharge channel, processing the detected component in an optimal manner to obtain a correction signal, and correcting the video data with the correction signal.

The matrix display apparatus of this invention includes: a plurality of pixels arranged in a matrix having a plurality of rows and a plurality of columns; a plurality of row selection elements provided to correspond to the plurality of rows; a plurality of video signal supply elements provided to correspond to the plurality of columns; a scanning circuit for supplying a scanning signal sequentially to the plurality of row selection elements for line-sequential scanning of the plurality of pixels for each of the plurality of rows; and a signal generation supply circuit for generating a video signal corresponding to video data to be displayed and supplying the video signal to the plurality of video signal supply elements in synchronization with the line-sequential scanning, wherein a given first pixel of the plurality of pixels belongs to one of a plurality of row groups each having a plurality of continuous rows, and the signal generation supply circuit receives video data, corrects first video data to be displayed by the first pixel based on a predetermined correction function that includes as variables the first video data and second video data to be displayed by a second pixel belonging to a same group and a same column as the first pixel and belonging to a row different from the first pixel and depends on the relative positional relationship between at least the first pixel and the second pixel, generates a video signal corresponding to the corrected first video data, and supplies the generated video signal to the video signal supply element corresponding to the column to which the first pixel belongs.

In one embodiment, each of the plurality of row groups includes at least three continuous rows, and the correction function is a predetermined function that further includes as a variable third video data to be displayed by a third pixel belonging to a same row group and a same column as the first pixel and belonging to a row different from the first pixel and the second pixel and further depends on the relative positional relationship between the first pixel and the third pixel.

In another embodiment, the correction function is a predetermined function that further includes as a variable third video data to be displayed by a third pixel belonging to a same row group as the first pixel, belonging to a column different from the first pixel, and located adjacent to the first or second pixel and further depends on the relative positional relationship between the first pixel and the third pixel.

In still another embodiment, the correction function is a predetermined function that further includes as a variable fourth video data to be displayed by a fourth pixel belonging to a same row group as the first pixel, belonging to a column different from the first pixel, and located adjacent to the first or second pixel and further depends on the relative positional relationship between the first pixel and the fourth pixel.

In still another embodiment, the correction function is a linear function of the first video data and the second video data.

In still another embodiment, a coefficient of the linear function by which the first video data and the second video data are multiplied is predetermined based on brightness characteristics of the plurality of pixels.

In still another embodiment, wherein the signal generation supply circuit includes an interference detection correction circuit, and the interference detection correction circuit executes the correction based on the correction function by an arithmetic operation.

In still another embodiment, the signal generation supply circuit executes the correction based on the correction function by use of a lookup table.

In still another embodiment, the matrix display apparatus further includes a plurality of plasma discharge channels each having a plurality of scanning lines running therein, wherein each of the plurality of row groups corresponds to each of the plurality of plasma discharge channels, and each of the plurality of row selection elements corresponds to each of the plurality of scanning lines.

The plasma addressed display apparatus of this invention includes: a panel having a layered structure essentially composed of a plasma cell and a display cell laminated together, the plasma cell including plasma discharge channels arranged in rows each having at least two scanning lines allocated thereto, the display cell including data electrodes arranged in columns, pixels being defined at intersections between the plasma discharge channels and the data electrodes forming a matrix; a vertical scanning circuit for effecting scanning of the panel by applying a discharge pulse sequentially to the plasma discharge channels; a signal circuit for supplying video data to the data electrodes in synchronization with the scanning; and an interference detection correction circuit for detecting correlation between video data for the scanning lines allocated to the same plasma discharge channel and correcting the video data to be supplied to the data electrodes according to the detected correlation.

In one embodiment, the interference detection correction circuit includes a line memory for accumulating video data for one scanning period required for an operation using video data of adjacent scanning lines.

In another embodiment, the interference detection correction circuit completes the operation using video data of adjacent scanning lines within the scanning lines allocated to the same plasma discharge channel.

In another embodiment, the interference detection correction circuit includes a complete control circuit that considers a possible shift of a vertical display position of video data when the video data is displayed on the plasma addressed display apparatus.

In still another embodiment, the interference detection correction circuit determines a correction amount by a lookup table method using a memory.

In still another embodiment, the interference detection correction circuit compensates a vertical high frequency gain of the video data.

In still another embodiment, the interference detection correction circuit accumulates video data for one scanning period required for extracting a vertical high component in the line memory.

In still another embodiment, the interference detection correction circuit sets an optimal gain in cooperation with a gain control circuit for correcting interference.

In still another embodiment, the interference detection correction circuit includes a noise reduction circuit for reducing noise.

In still another embodiment, the noise reduction circuit controls a reduction amount according to a noise level of the video data.

In still another embodiment, the noise reduction circuit stores noise reduction compensation characteristics in a memory.

In still another embodiment, the interference detection correction circuit determines a correction amount in consideration of electrooptical characteristics of the display cell.

In still another embodiment, the interference detection correction circuit stores the electrooptical characteristics in a memory.

BRIEF DESCRIPTION OF THE DRAWINGS

FIG. 1B is a diagrammatic view of pixels Pix(M,N) of four rows and two columns of the matrix display apparatus of FIG. 1A, illustrating the first example of correction processing according to the present invention.

FIG. 1C is a diagrammatic view of pixels Pix(M,N) of six rows and two columns of the matrix display apparatus of FIG. 1A, illustrating the second example of correction processing according to the present invention.

FIG. 1D is a diagrammatic view of pixels Pix(M,N) of four rows and four columns of the matrix display apparatus of FIG. 1A, illustrating the third example of correction processing according to the present invention.

DESCRIPTION OF THE PREFERRED EMBODIMENTS

Figure 1A:
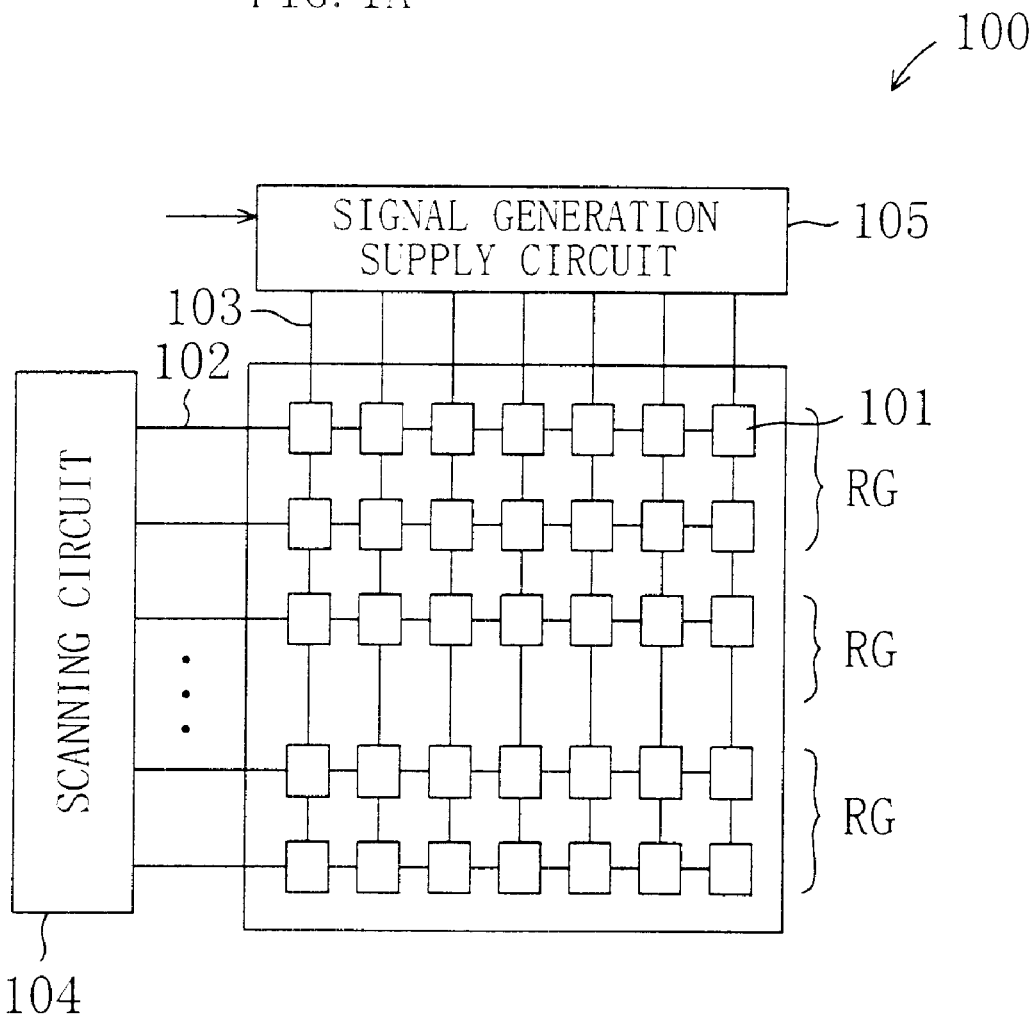
FIG. 1A is a diagrammatic view of a matrix display apparatus according to the present invention.

First, the construction and operation of a matrix display apparatus 100 of an embodiment of the present invention will be described with reference to FIG. 1A. FIG. 1A is a view diagrammatically illustrating the matrix display apparatus 100 having pixels arranged in a matrix of M rows and N columns (hereinafter, referred to as (M,N)).

The matrix display apparatus 100 according to the present invention includes: a plurality of pixels 101 arranged in a matrix constituting a plurality of rows (pixel rows) and a plurality of columns (pixel columns); a plurality of row selection elements 102 provided to correspond to the plurality of rows; a plurality of video signal supply elements 103 provided to correspond to the plurality of columns; a scanning circuit 104; and a signal generation supply circuit 105. The scanning circuit 104 supplies a scanning signal sequentially to the plurality of row selection elements 102 so as to effect line-sequential scanning of the plurality of pixels 101 for each row. The signal generation supply circuit 105 receives video data (indicated by the arrow in FIG. 1A), generates video signals corresponding to the video data to be displayed, and supplies them to the plurality of video signal supply elements 103 in synchronization with the line-sequential scanning. A video signal corresponding to video data to be displayed by a given pixel 101 is supplied to the video signal supply element 103 in synchronization with the scanning signal for selecting the row to which the pixel 101 belongs. As a result, the pixel 101 exhibits the predetermined display state corresponding to the video data. This operation is repeated sequentially for each row, whereby all the pixels exhibit their predetermined display states. This matrix display apparatus 100 is therefore a line-sequential drive type matrix display apparatus.

In the process of generating a video signal based on the received video data, the signal generation supply circuit 105 corrects the video data so as to compensate interference between video data that may occur between the pixels 101. The specific pixels that may generate interference and the degree of the interference can be predetermined by measuring the relationship between the amplitude of a video signal (video voltage) to be applied to each pixel 101 and the display state (brightness).

All the pixels 101 are grouped into row groups (RG) composed of a plurality of continuous rows (pixel rows). In the plasma addressed display apparatus described above, for example, such row groups RG correspond to plasma discharge channels. Each pixel 101 belongs to only one row group RG. This grouping of rows of the pixels 101 is made so that the resultant row group corresponds to a construction unit in which interference between video data tends to occur significantly (for example, the plasma discharge channel).

Thus, a given pixel belongs to one of a plurality of row groups RG. Correction of video data for compensating interference (resulting in minimizing the interference) is completed within this row group RG. To state conversely, pixels are grouped into row groups so that interference between video data can be sufficiently compensated (minimized) by completing the correction within the respective row groups.

The correction is carried out in the following manner.

Video data (first video data) to be displayed by a given pixel 101 (first pixel or focusing pixel) is corrected based on a correction function including as variables the first video data and video data (second video data) to be displayed by a pixel 101 (second pixel) that belongs to the same row group RG and the same column as the first pixel 101 and belongs to a row different from the first pixel 101. Such a correction function depends on the relative positional relationship between the first and second pixels 101. Naturally, if interference between video data occurs not only between the two pixels 101 but also between the first pixel 101 and a third pixel 101 belonging to the same column as or a different column from the first pixel 101, the correction function will also depends on video data to be displayed by the third pixel 101 and the relative positional relationship between the first pixel lot and the third pixel 101. The correction function is predetermined based on information obtained by measuring the relationship between the amplitude of a video signal (video voltage) to be applied to each pixel 101 and the display state (brightness). The signal generation supply circuit 105 generates a video signal corresponding to the corrected first video data and supplies the signal to the video signal supply element corresponding to the column to which the first pixel belongs. In this way, display with minimized interference between video data is realized.

The correction processing will be described concretely with reference to FIG. 1B. FIG. 1B diagrammatically shows the pixels Pix(M,N) of four rows and two columns of the matrix display apparatus. Data(M,N) in FIG. 1B and the subsequent figures represents video data to be displayed by the corresponding pixels Pix(M,N). In this example, rows m and m+1 belong to one row group RG, while rows m+2 and m+3 belong to another row group RG.

In this example, Data(m,n) to be displayed by the pixel Pix(m,n) is corrected by executing an operation using Data (m,n) and Data(m+1,n) to be displayed by the pixel Pix(m+1,n) located immediately below the pixel Pix(m,n), that is, corrected based on a correction function having these video data as variables. Similarly, Data(m+1,n) to be displayed by the pixel Pix(m+1,n) is corrected by executing an operation using Data(m+1,n) and Data(m,n) to be displayed by the pixel Pix(m,n) located immediately above the pixel Pix(m+1,n), that is, corrected based on a correction function having these video data as variables. The operation for correcting Data(m,n) (correction function) and the operation for correcting Data(m+1,n) (correction function) may be the same or different from each other, depending on the structure and the drive method of the display apparatus, and the like.

An example of the operation for correction processing (correction function) will be described.

Assume that Pix(m,n) is the first pixel (focusing pixel) to be corrected and Pix(m+1,n) is the second pixel (interfering pixel) influencing the first pixel. First, an interference component Derr(m,n) against Pix(m,n) is determined from the two video data. Derr(m,n) is data indicating the degree of interference received by Pix(m,n), which mainly depends on the difference between Data(m,n) and Data(m+1,n). Therefore, Derr(m,n) is represented as a linear function as follows:

$$\mathrm{Derr}(m,n)=K3*\{K1*\mathrm{Data}(m,n)-K2*\mathrm{Data}(m+1,n)\}$$

wherein K1 and K2 denote the coefficients indicating the ratio of the degrees of influence between Data(m,n) and Data(m+1,n) that interfere with each other, and K3 denotes the coefficient indicating the degree of influence of the interference on the actual display (also called the gain coefficient). The coefficient K3 may be a constant independent of the value of video data or may be a function of the gamma characteristics of the matrix display apparatus. The coefficients K1, K2, and K3 are determined based on the brightness characteristics (electrooptical characteristics) of the pixels. In the above and following equations, "*" denotes multiplication.

The thus-obtained Derr(m,n) is added to Data(m,n) of the first pixel Pix(m,n), to obtain corrected video data NewData. The corrected video data NewData can therefore be represented as a linear function as follows having Data(m,n) and Data(m+1,n) as variables.

$$\text{NewData}(m,n)=\text{Data}(m,n)+\text{Derr}(m,n)=\text{Data}(m,n)+\text{K3}^*\{K1^*\text{Data}(m,n)-K2^*\text{Data}(m+1,n)\}$$

Next, assume that Pix(m+1,n) is the first pixel to be corrected (focusing pixel) and Pix(m,n) is the second pixel influencing the first pixel (interfering pixel). An interference component Derr(m,n) against Pix(m+1,n) is determined from the two video data in the manner described above.

$$\text{Derr}(m+1,n)=J3^*\{J1^*\text{Data}(m+1,n)-J2^*\text{Data}(m,n)\}$$

wherein J1, J2, and J3 denote the coefficients. K1=J1, K2=J2, and K3=J3 may be or may not be satisfied depending on the drive conditions of the matrix display apparatus and the like. Otherwise, K1=J2 and K2=J1 may be satisfied. In other words, Derr(m,n) is generally represented by a function that depends on the relative positional relationship between the focusing pixel and the interfering pixel.

The thus-obtained Derr(m+1,n) is added to Data(m+1,n) of the first pixel Pix(m+1,n), to obtain corrected video data NewData(m+1,n).

$$\text{NewData}(m+1,n)=\text{Data}(m+1,n)+\text{Derr}(m+1,n)=\text{Data}(m+1,n)+J3^*\{J1^*\text{Data}(m+1,n)-J2^*\text{Data}(m,n)\}$$

As described above, correction can be made using video data of Pix(m,n) and Pix(m+1,n) that interfere with each other. In the adjacent column, similarly, the respective video data are corrected using video data of Pix(m,n+1) and Pix(m+1,n+1).

Thus, in this embodiment, interference between video data of two pixels can be compensated by executing operations using the video data in the area including the two pixels. Moreover, There is no overlap in the vertical direction between areas for the correction processing. Specifically, correction for the pixel Pix(m+2,n) is made within the area composed of Pix(m+2,n) and Pix(m+3,n).

The above example of correction processing is a case where one row group RG includes two rows. One row group RG may also include three or more rows. In the above example, also, correction processing is performed based on the correction function represented as a linear function of video data (simple four fundamental operations). The correction function is not limited to the above, but can be appropriately changed depending on the brightness characteristics and drive method of the matrix display apparatus, the kind of video data to be input, and the correction precision required. The correction processing may be realized using a circuit for executing the operations (for example, an interference detection correction circuit to be described later) or using a look-up table.

Next, correction processing in the case where one row group RG includes three continuous rows will be described with reference to FIG. 1C. Herein, for simplification, compensation of interference among three pixels belonging to the same column will be described. In this case, therefore, the correction function includes as an additional variable third video data to be displayed by a third pixel that belongs to the same column as the first pixel (focusing pixel) and belongs to a row different from the first and second pixels. This correction function further depends on the relative positional relationship between the first pixel and the third pixel.

FIG. 1C shows the pixels Pix(M,N) of six rows and two columns of the matrix display apparatus 100. In this example, rows m, m+1, and m+2 belong to one row group RG, while rows m+3, m+4, and m+5 belong to another row group RG.

In this example, interference among the three pixels Pix(m,n), Pix(m+1,n), and Pix(m+2,n) is compensated by executing operations using video data of these pixels within an area composed of these pixels that interfere with one another.

First, assume that Pix(m,n) is the first pixel to be corrected and Pix(m+1,n) and Pix(m+2,n) are the second and third pixels influencing the first pixel. An interference component is determined based on the video data of these pixels. An interference component Derr(m,n) against the first pixel Pix(m,n) is represented as follows:

$$\text{Derr}(m,n)=Fa[\text{Data}(m,n),\ \text{Data}(m+1,n),\ \text{Data}(m+2,n)]$$

wherein Fa denotes a function having Data(m,n), Data(m+1,n), and Data(m+2,n) as variables. It may be or may not be a linear function.

The thus-obtained Derr(m,n) is added to video data Data(m,n) of the first pixel Pix(m,n), to obtain corrected video data NewData(m,n).

$$\text{NewData}(m,n)=\text{Data}(m,n)+\text{Derr}(m,n).$$

Next, when Pix(m+1,n) is the first pixel to be corrected, Pix(m,n) and Pix(m+2,n) are the interfering second and third pixels influencing the first pixel Pix(m+1,n). The interference component Derr(m+1,n) against Pix(m+1,n) is therefore obtained from the following equation.

$$\text{Derr}(m+1,n)=Fb[\text{Data}(m+1,n),\ \text{Data}(m,n),\ \text{Data}(m+2,n)]$$

wherein Fb denotes a function having Data(m+1,n), Data(m,n), and Data(m+2,n) as variables. Fb may be the same as or different from Fa described above. In other words, Derr(m,n) is generally represented by a function that depends on the relative positional relationship between the focusing pixel and the interfering pixels.

The thus-obtained Derr(m+1,n) is added to video data Data(m+1,n) of the first pixel Pix(m+1,n), to obtain corrected video data NewData(m+1,n).

$$\text{NewData}(m+1,n)=\text{Data}(m+1,n)+\text{Derr}(m+1,n).$$

Similarly, when Pix(m+2,n) is the first pixel to be corrected, Pix(m,n) and Pix(m+1,n) are the interfering second and third pixels influencing the first pixel Pix(m+2,n). An interference component Derr(m+2,n) against Pix(m+2,n) is therefore obtained from the following equation.

$$\text{Derr}(m+2,n)=Fc[\text{Data}(m+2,n),\ \text{Data}(m,n),\ \text{Data}(m+1,n)]$$

wherein Fc denotes a function having Data(m+2,n), Data(m,n), and Data(m+1,n) as variables, which may be the same as or different from Fa and Fb described above. In other words, Fa, Fb, and Fc depend on the respective relative positional relationships between the pixels.

The thus-obtained Derr(m+2,n) is added to video data Data(m+2,n) of the first pixel Pix(m+2,n), to obtain corrected video data NewData(m+2,n).

$$NewData(m+2,n)=Data(m+2,n)+Derr(m+2,n).$$

As described above, correction can be made using video data of Pix(m,n), Pix(m+1,n), and Pix(m+2,n) that influence one another. Likewise, in the case of the adjacent column, respective video data are corrected using video data of Pix(m,n+1), Pix(m+1,n+1), and Pix(m+2,n+1).

Thus, in this example, interference among three pixels can be compensated by executing operations using video data of these pixels within an area composed of these pixels. Moreover, there is no overlap in. the vertical direction between areas for the correction processing. Specifically, correction for Pix(m+3,n) is made in an area composed of Pix(m+3,n), Pix(m+4,n), and Pix(m+5,n).

Next, processing for compensating interference among four or more pixels will be described with reference to FIGS. 1D, 1E, 1F, 1G, and 1H. That is, the following examples allow for compensating an influence from a pixel belonging to a column different from that to which the first pixel (focusing pixel) belongs. In general, the first pixel is most influenced by pixels located nearest to the first pixel. Accordingly, if one row group includes three or more rows, compensation may be made for interference among nine pixels at maximum in order to obtain a sufficient effect of minimizing the interference.

In the following description, the case where one row group includes two rows will be used for simplification. Assume that pixels interfering with the first pixel are: the second and third pixels that are adjacent to the first pixel and belong to the same row as the first pixel; and fourth, fifth, and sixth pixels that are adjacent to the first, second, and third pixels, respectively, and belong to a row different from the row to which the first pixel belongs.

Figure 1E:
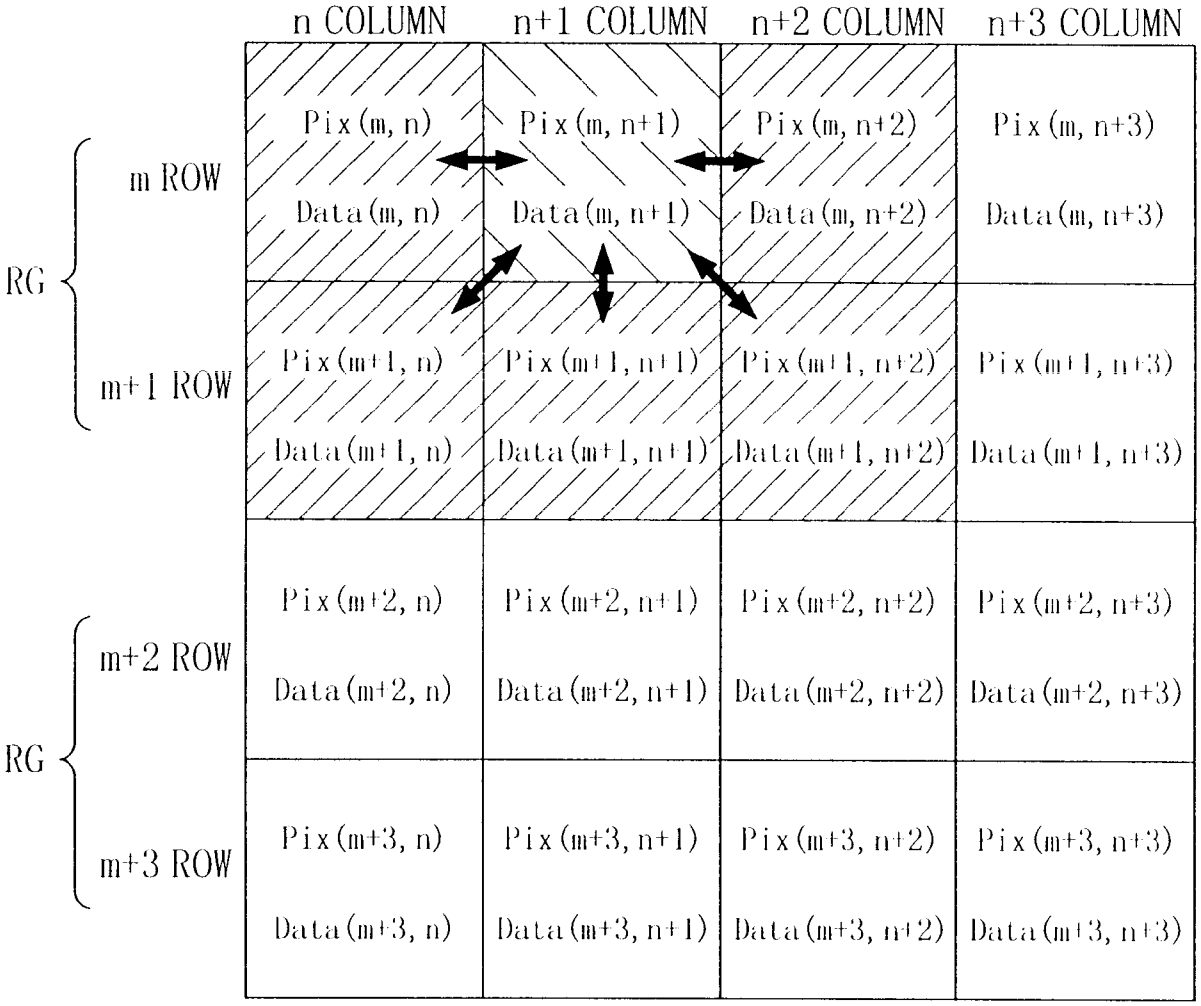
FIG. 1E is a diagrammatic view of pixels Pix(M,N) of four rows and four columns of the matrix display apparatus of FIG. 1A, illustrating the third example of correction processing (for Pix(m,n+1)) according to the present invention.

Referring to FIG. 1E, assuming that Pix(m,n+1) is the first pixel, it is influenced by the surrounding pixels Pix(m,n), Pix(m,n+2), Pix(m+1,n), Pix(m+1,n+1), and Pix(m+1,n+2). Therefore, a correction value for the first pixel is determined from video data of these pixels. In the same manner as that described above, an interference component Derr(m,n+1) for Pix(m,n+1) is obtained from the following equation.

$$Derr(m,n+1)=F0\ [Data(m,n+1),\ Data(m,n+2),\ Data(m,n),\ Data(m+1,n),\ Data(m+1,n+1),\ Data(m+1,n+2)]$$

wherein F0 denotes a function having Data(m,n+1), Data (m,n+2), Data(m,n), Data(m+1,n), Data(m+1,n+1), and Data (m+1,n+2) as variables. The resultant value is added to video data Data(m,n+1) of the first pixel Pix(m,n+1), to obtain corrected data NewData(m,n+1).

$$NewData(m,n+1)=Data(m,n+1)+Derr(m,n+1)$$

Figure 1F:
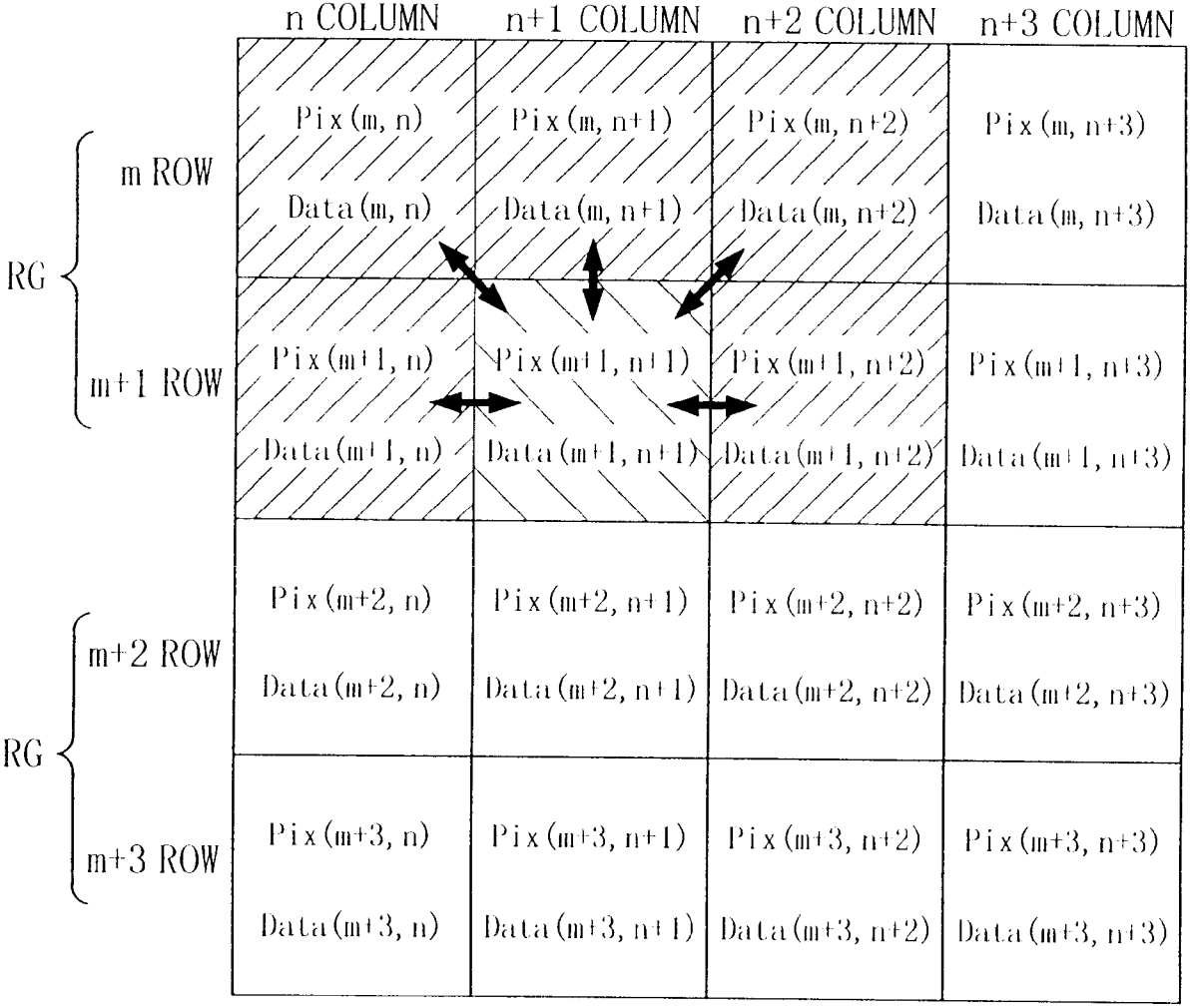
FIG. 1F is a diagrammatic view of pixels Pix(M,N) of four rows and four columns of the matrix display apparatus of FIG. 1A, illustrating the third example of correction processing (for Pix(m+1,n+1)) according to the present invention.
Figure 1G:
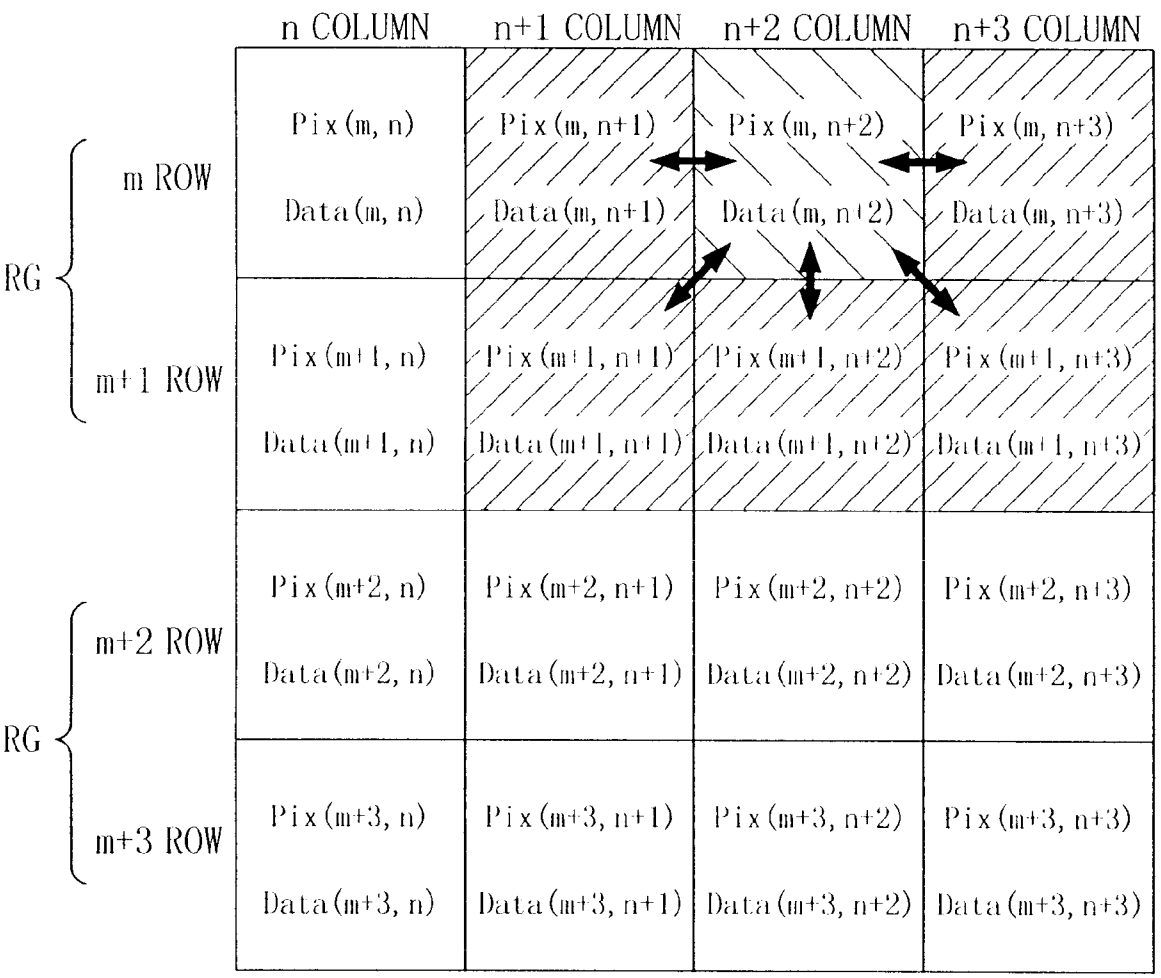
FIG. 1G is a diagrammatic view of pixels Pix(M,N) of four rows and four columns of the matrix display apparatus of FIG. 1A, illustrating the third example of correction processing (for Pix(m,n+2)) according to the present invention.
Figure 1H:
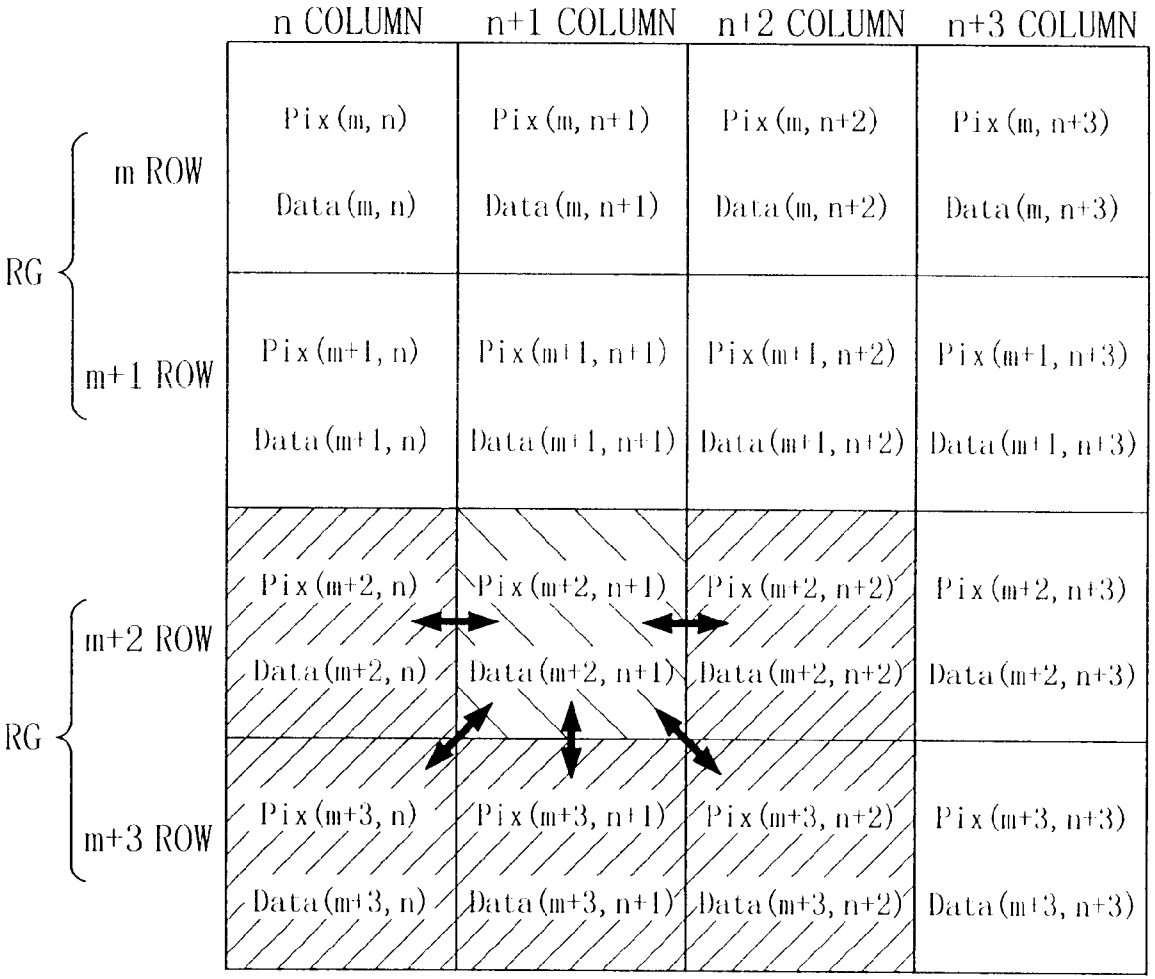
FIG. 1H is a diagrammatic view of pixels Pix(M,N) of four rows and four columns of the matrix display apparatus of FIG. 1A, illustrating the third example of correction processing (for Pix(m+2,n+1)) according to the present invention.

Similarly, when the first pixel is Pix(m+1,n+1), correction is made based on video data in the area shown in FIG. 1F. The function for determining Derr(m+1,n+1) may be or may not be different from F0 described above. When the first pixel is Pix(m,n+2) in the next column, correction is made based on video data in the area shown in FIG. 1G. When the first pixel is Pix(m+2,n+1), correction is made based on video data in the area shown in FIG. 1H. In this way, interference can be compensated by executing operations using video data of six pixels within the area composed of the six pixels interfering with one another. There is no overlap in the vertical direction between areas for the correction processing.

Hereinafter, preferred embodiments of the plasma addressed display apparatus of the present invention will be described with reference to the accompanying drawings.

Embodiment 1

Figure 2A:
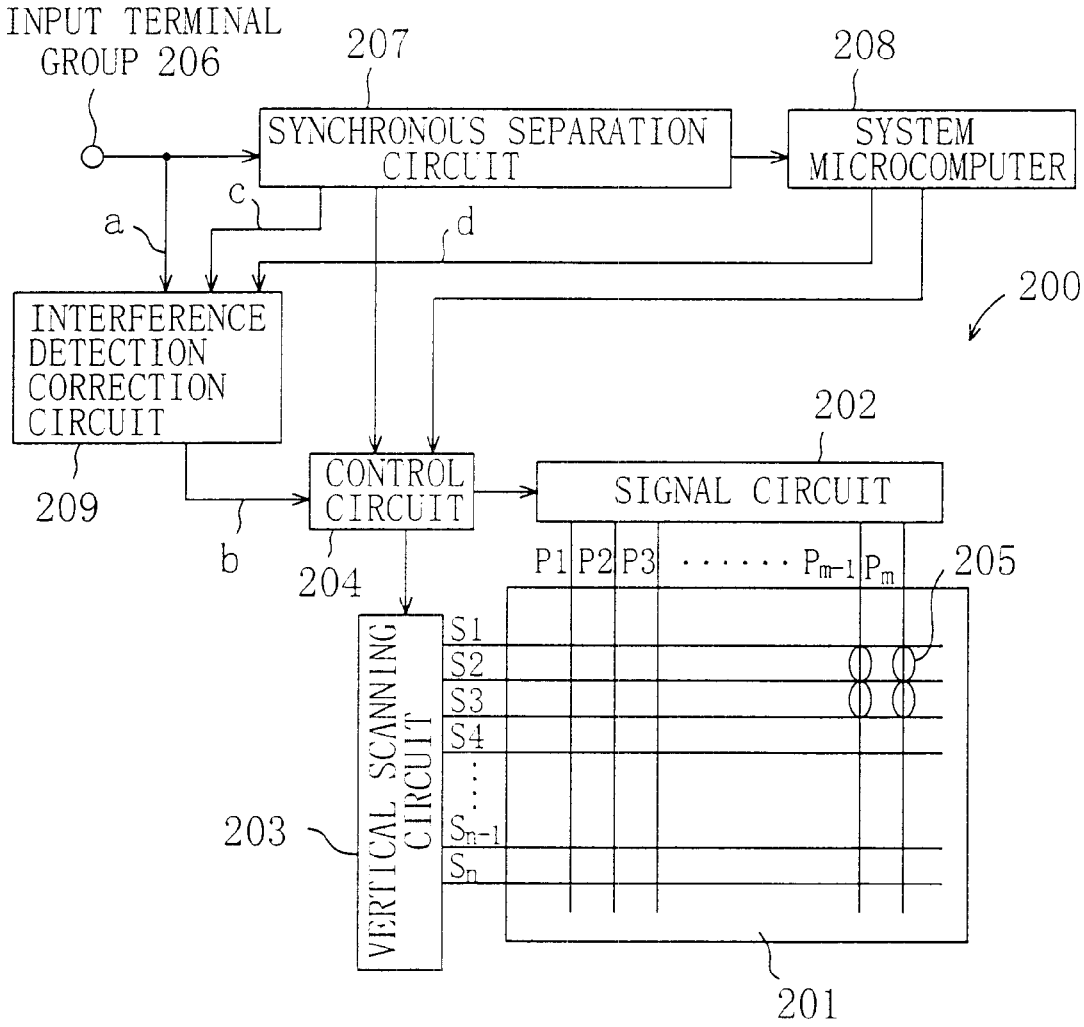
FIG. 2A is a block diagram of the entire construction of a plasma addressed display apparatus according to the present invention.

FIG. 2A shows the entire construction of a plasma addressed display apparatus 200 according to the present invention. Referring to FIG. 2A, the plasma addressed display apparatus 200 includes a panel 201, a signal circuit 202, a vertical scanning circuit 203, a control circuit 204, an input terminal group 206, a synchronous separation circuit 207, a system microcomputer 208, and an interference detection correction circuit 209.

The panel 201 has a flat panel structure essentially composed of a plasma cell and a display cell laminated together. The plasma cell has scanning electrodes S1 to Sn arranged in rows, and the display cell has data electrodes P 1 to Pm. Pixels 205 are defined at respective intersections between the scanning electrodes S1 to Sn and the data electrodes P1 to Pm. The signal circuit 202 supplies video data to the data electrodes P1 to Pm in synchronization with the scanning by the vertical scanning circuit 203. The vertical scanning circuit 203 applies a discharge pulse line-sequentially to the scanning electrodes S1 to Sn for effecting scanning. The control circuit 204 controls the synchronization between the signal circuit 202 and the vertical scanning circuit 203.

An input signal a representing video data to be corrected is input via the input terminal group 206. The synchronous separation circuit 207 extracts a horizontal synchronous signal and a vertical synchronous signal from the input signal a, and supplies extracted various signals to the control circuit 204, the system microcomputer 208, and the interference detection correction circuit 209. The system microcomputer 208 manages the display phase of video data when displayed on the panel 201.

The plasma addressed display apparatus shown in FIG. 2A is characterized in that it includes the interference detection correction circuit 209. The interference detection correction circuit 209 performs interference detection and correction for the input signal a supplied via the input terminal group 206, and outputs a corrected output signal b to the control circuit 204. The interference detection correction circuit 209 also receives a vertical synchronous timing c from the synchronous separation circuit 207 and a vertical display phase signal d from the system microcomputer 208.

Figure 2B:
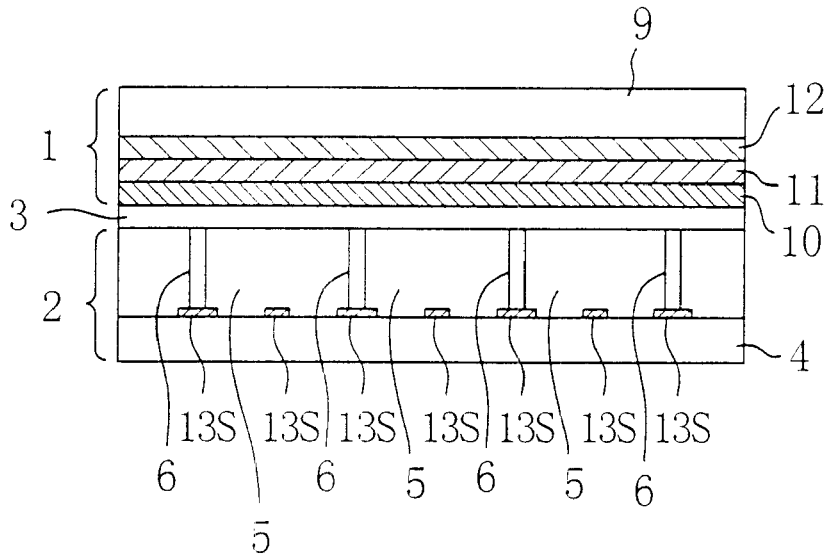
FIG. 2B is a view showing the structure of a panel of the plasma addressed display apparatus according to the present invention.

FIG. 2B shows a structure of the panel 201 of the plasma addressed display apparatus shown in FIG. 2A. This structure is the same as that of the plasma addressed display apparatus shown in FIG. 24 proposed by the present inventor and co-researchers. At least two scanning lines are allocated to each plasma discharge channel 5 defined by adjacent barrier ribs 6, a microsheet 3, and a glass substrate 4. Scanning electrodes S are sequentially selected by the vertical scanning circuit 203, to allow plasma discharge to be generated between the selected scanning electrode S and an adjacent scanning electrode S, whereby video data are sequentially written and retained.

A display cell 1 and a plasma cell 2 are laminated together via the microsheet 3 forming a flat panel structure. The plasma cell 2 includes a glass substrate 4 and the plasma discharge channels 5 arranged in rows on the glass substrate 4, for effecting scanning by causing plasma discharge to be generated in the plasma discharge channels 5 line-sequentially. The plasma discharge channels 5 are separated from the adjacent ones by the barrier ribs 6 that define spaces in rows. Stripe-shaped scanning electrodes (S) 13 are formed on the inner surface of the glass substrate 4 inside the respective plasma discharge channels 5. Ionizable gas is enclosed in the spaces of the respective plasma discharge channels 5. The scanning electrodes (S) 13 are disposed at the bottoms of the barrier ribs 6 and at positions between the adjacent barrier ribs 6.

The display cell 1 includes a liquid crystal layer 10 as a display medium retained between an upper glass substrate 9 and the microsheet 3. Stripe-shaped color filters 12 and stripe-shaped data electrodes (P) 11 are formed on the inner surface of the glass substrate 9 in this order so as to extend in the direction intersecting with the plasma discharge channels 5. Pixels are defined at the respective intersections of the color filters 12 and the data electrodes (P) 11 with the plasma discharge channels 5 forming a matrix.

Figure 3:
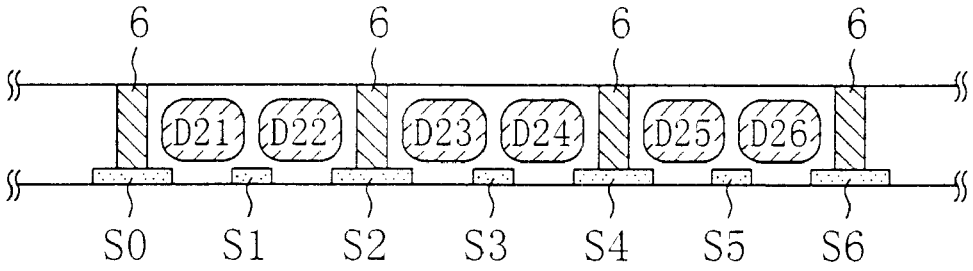
FIG. 3 is a diagrammatic illustration of the video data write operation of the plasma addressed display apparatus according to the present invention.
Figure 22:
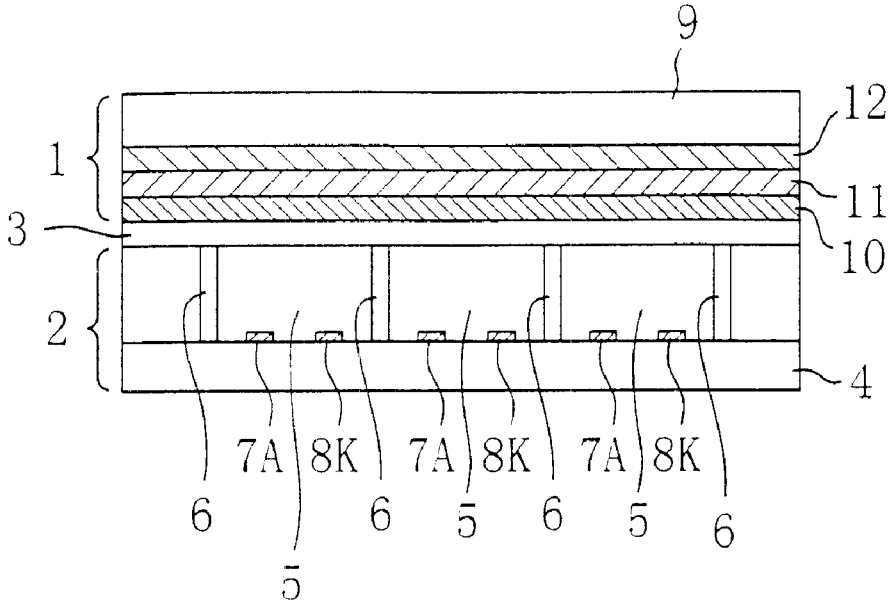
FIG. 22 (Prior Art)
FIG. 22 is a structural view of a panel of a conventional plasma addressed display apparatus.
Figure 23:
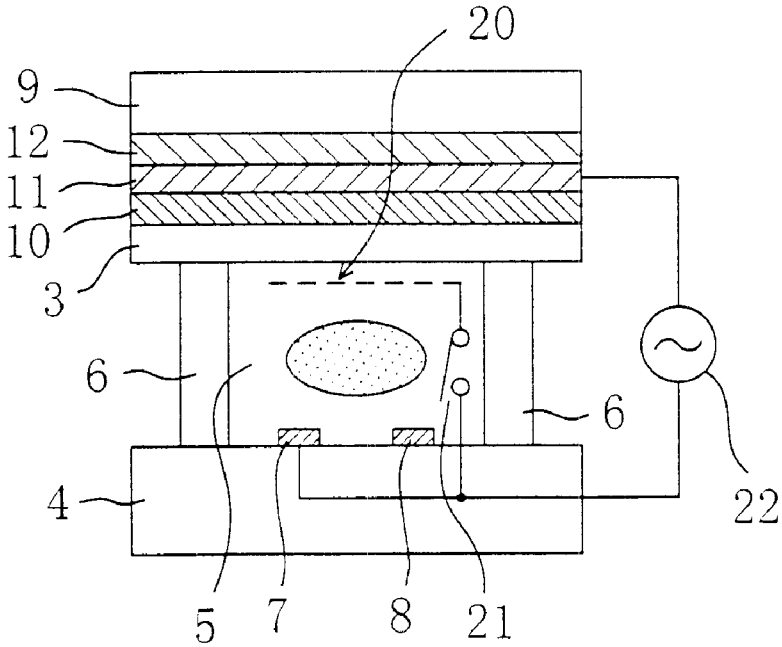
FIG. 23 (Prior Art)
FIG. 23 is an illustration of the operation of the conventional plasma addressed display apparatus.
Figure 24:
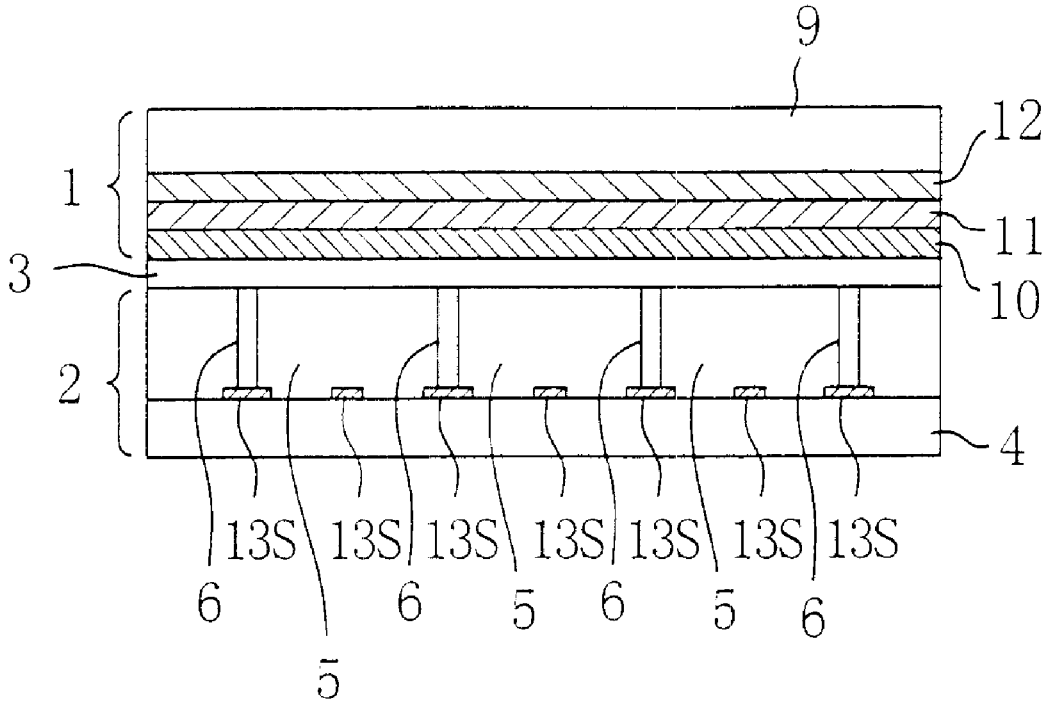
FIG. 24 is a structural view of a panel of a high-definition plasma addressed display apparatus proposed by the present inventor and co-researchers.
Figure 25A:
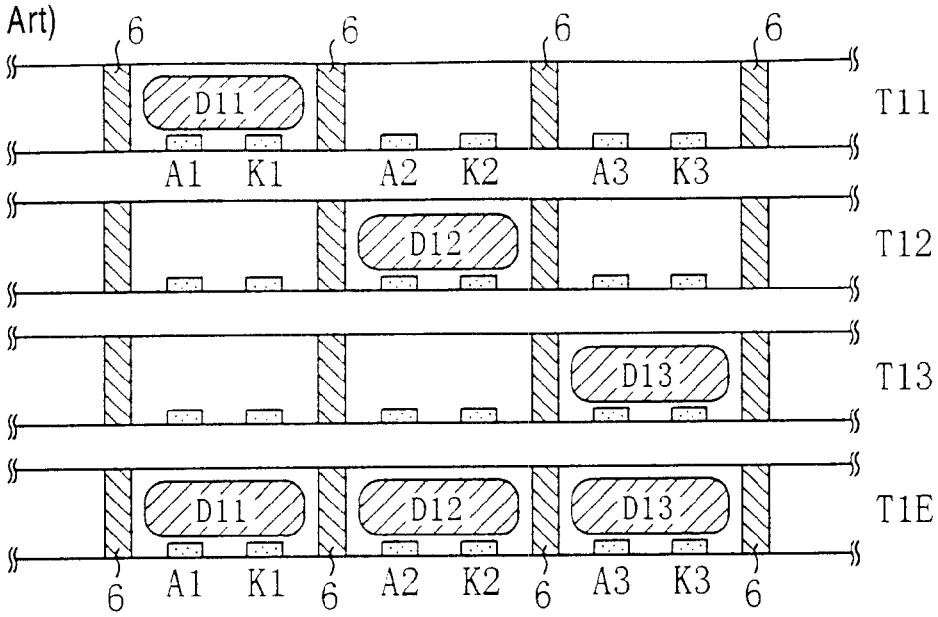
FIG. 25A (Prior Art)
FIGS. 25A and 25B are diagrammatic illustrations of the video data write operations of a conventional plasma addressed display apparatus (FIG. 25A) and the high-definition plasma addressed display apparatus proposed by the present inventor and co-researchers employing a conventional drive method (FIG. 25B).
Figure 25B:
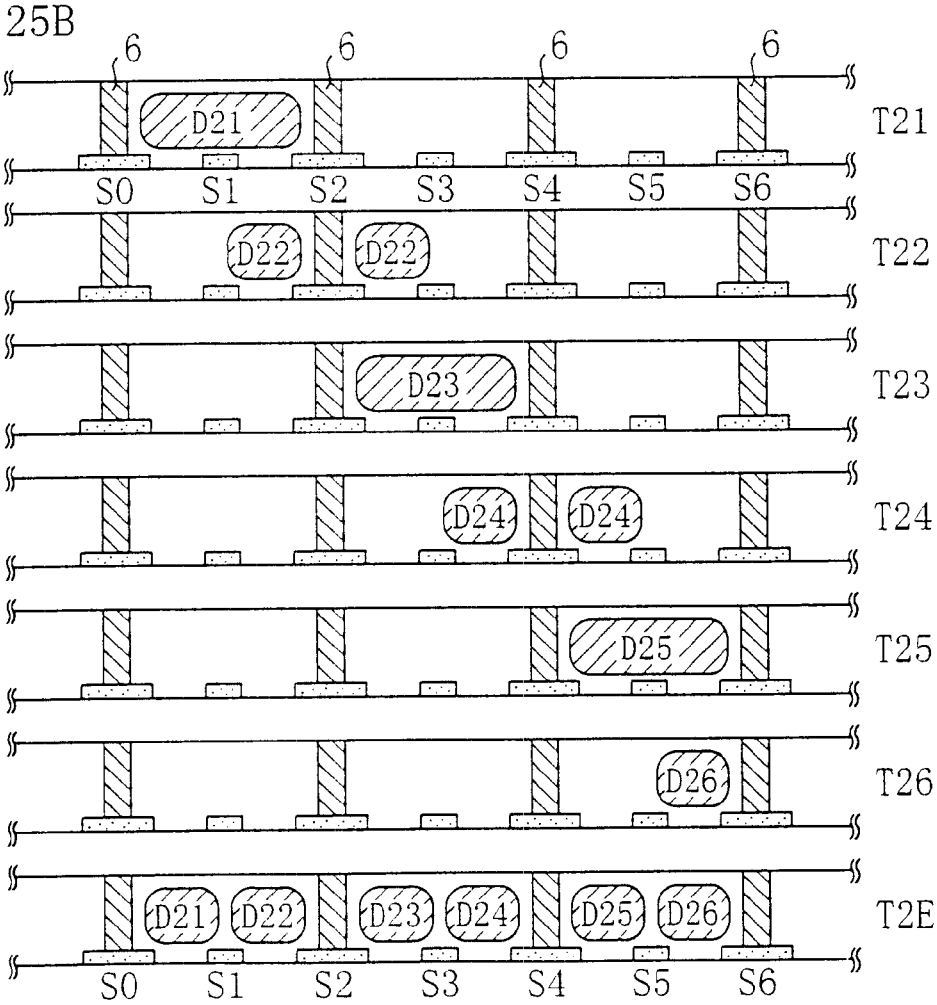
Figure 26:
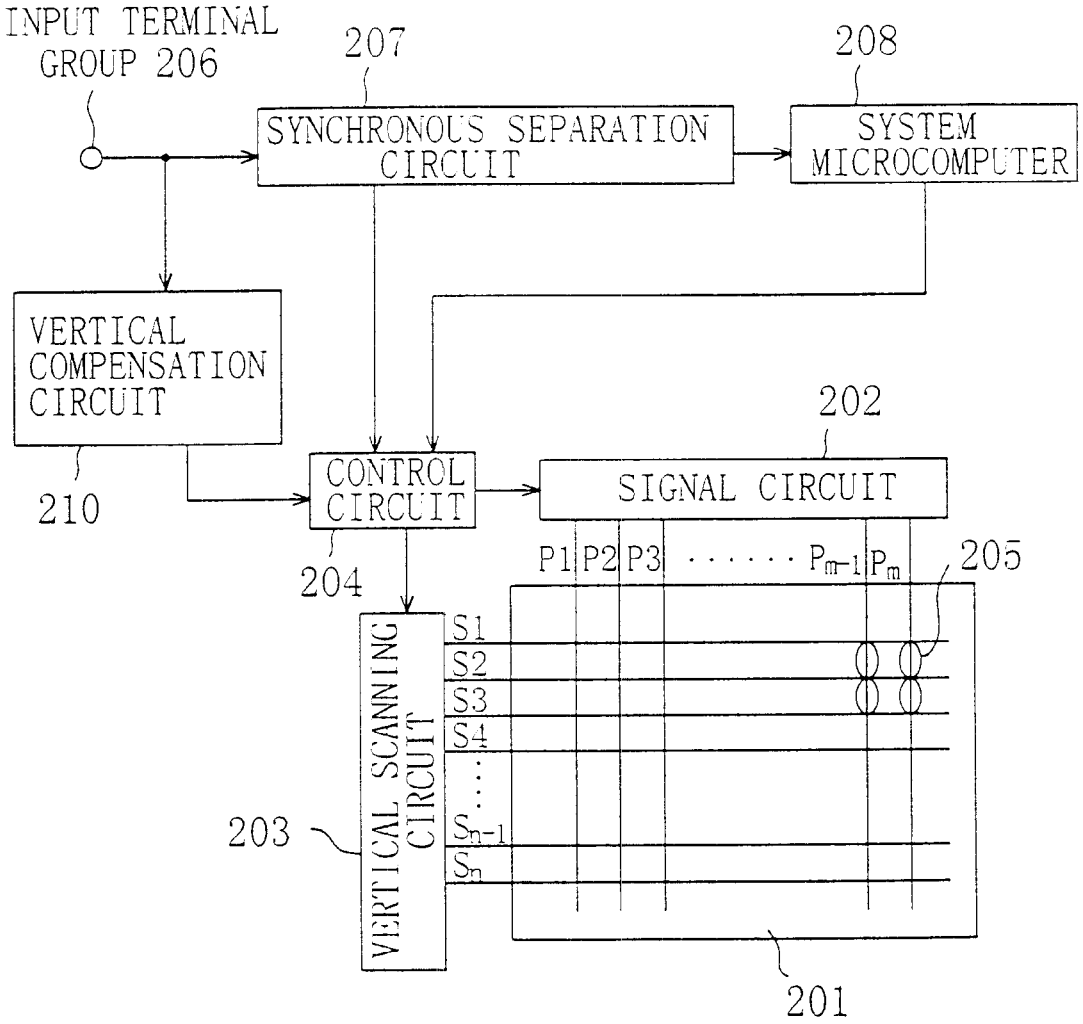
FIG. 26 is a block diagram of the entire construction of the high-definition plasma addressed display apparatus proposed by the present inventor and co-researchers.
Figure 27:
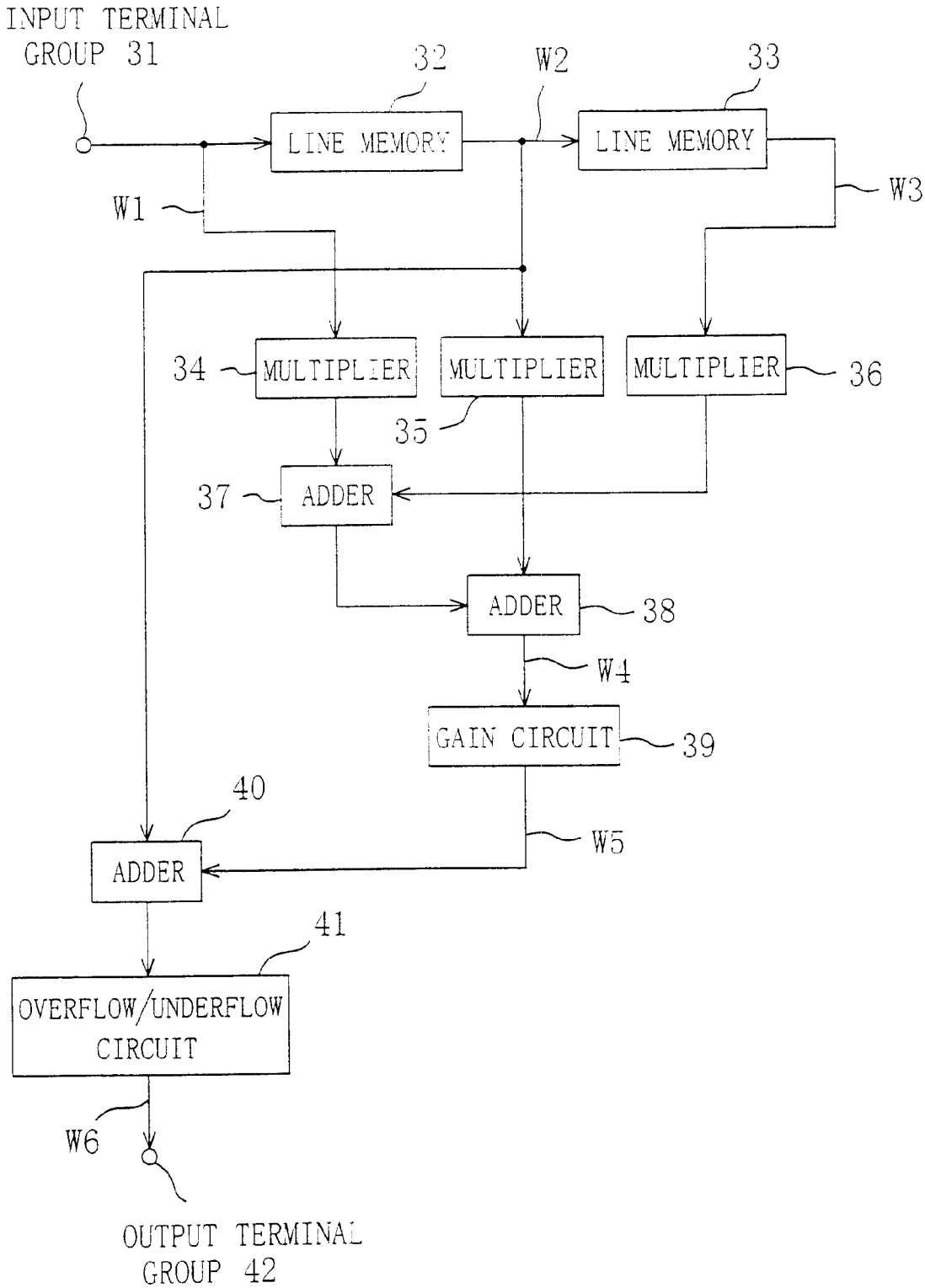
FIG. 27 is a block diagram of a vertical compensation circuit of the plasma addressed display apparatus of FIG. 26.
Figures 28A, 28B:
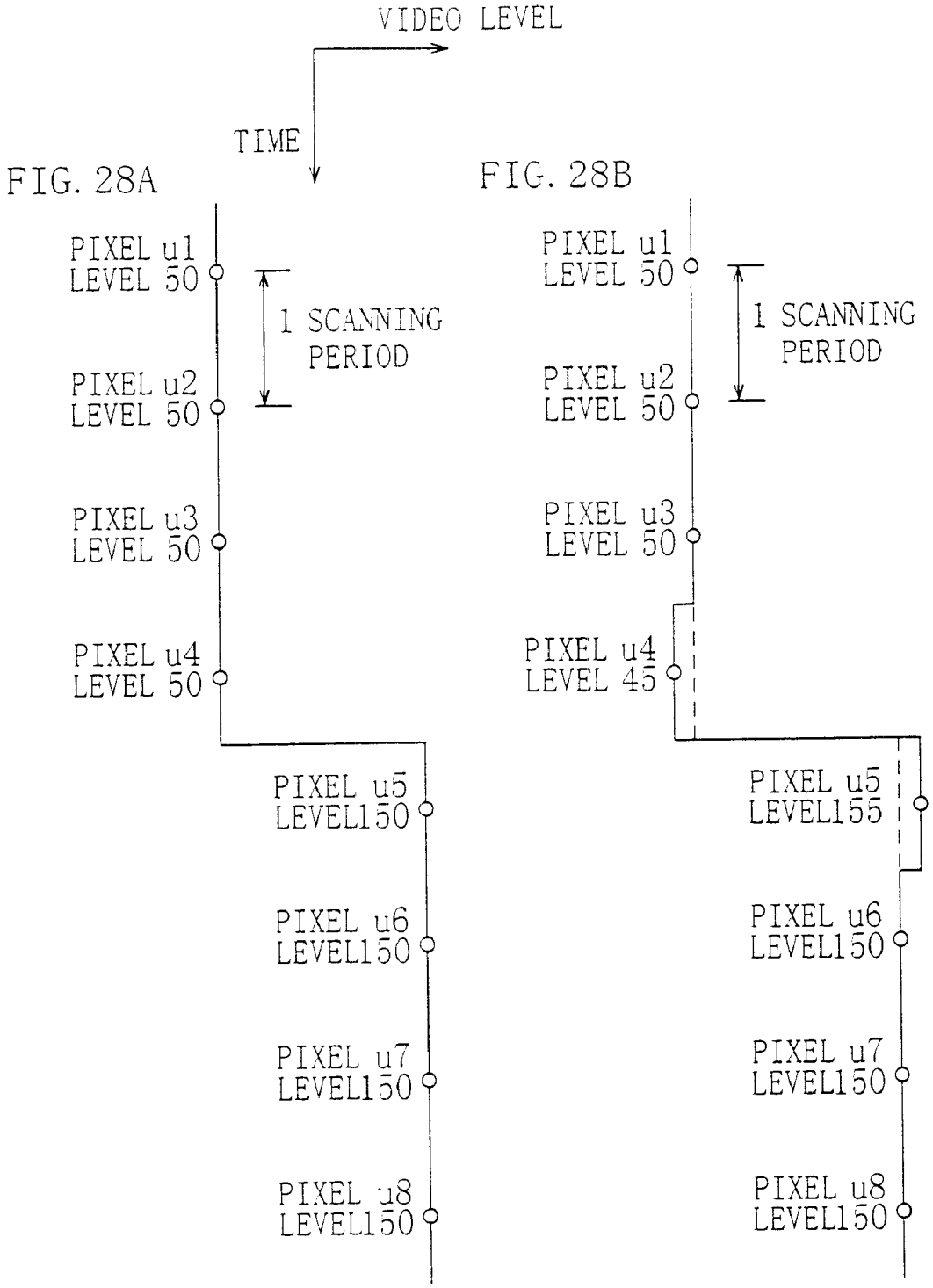
FIGS. 28A and 28B are diagrammatic illustrations of the vertical compensation operation by the vertical compensation circuit of FIG. 27.
Figure 29A:
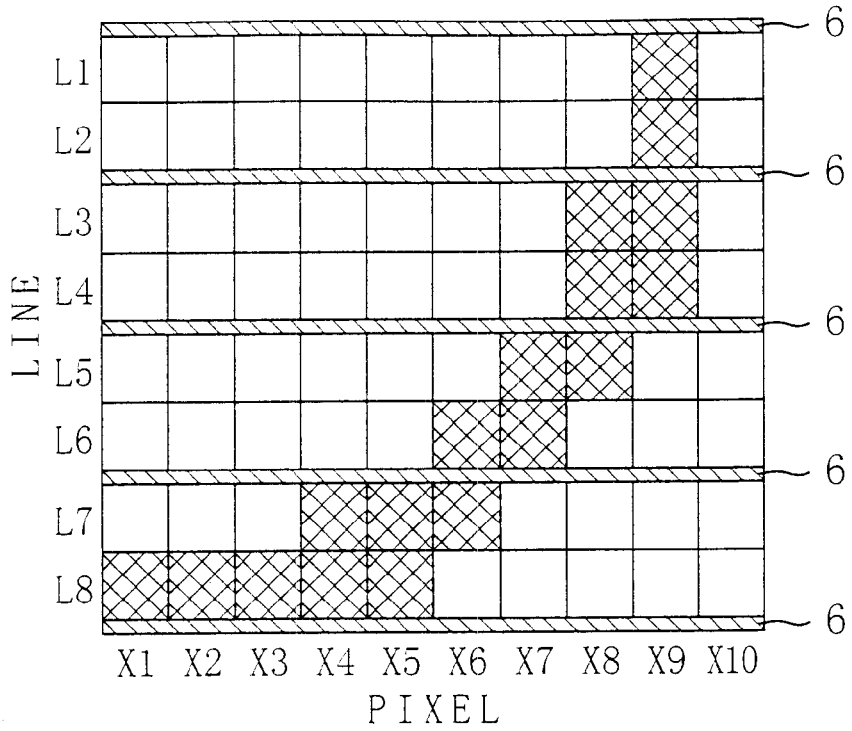
FIGS. 29A and 29B are diagrammatic illustrations for understanding of a problem arising when the high-definition plasma addressed display apparatus of FIG. 26 is operated by the conventional drive method.
Figure 29B:
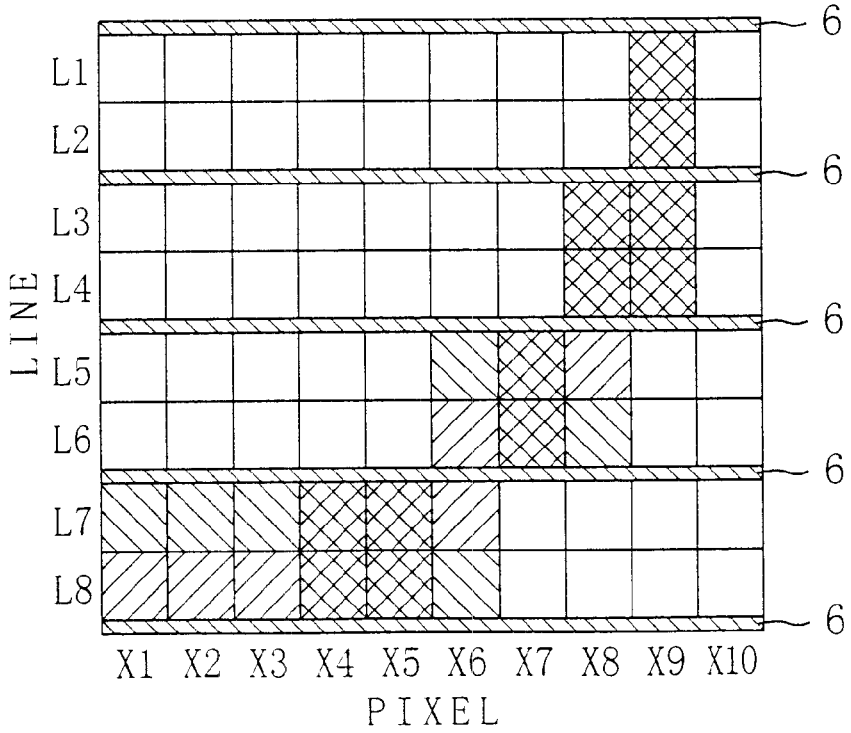
Figure 17:
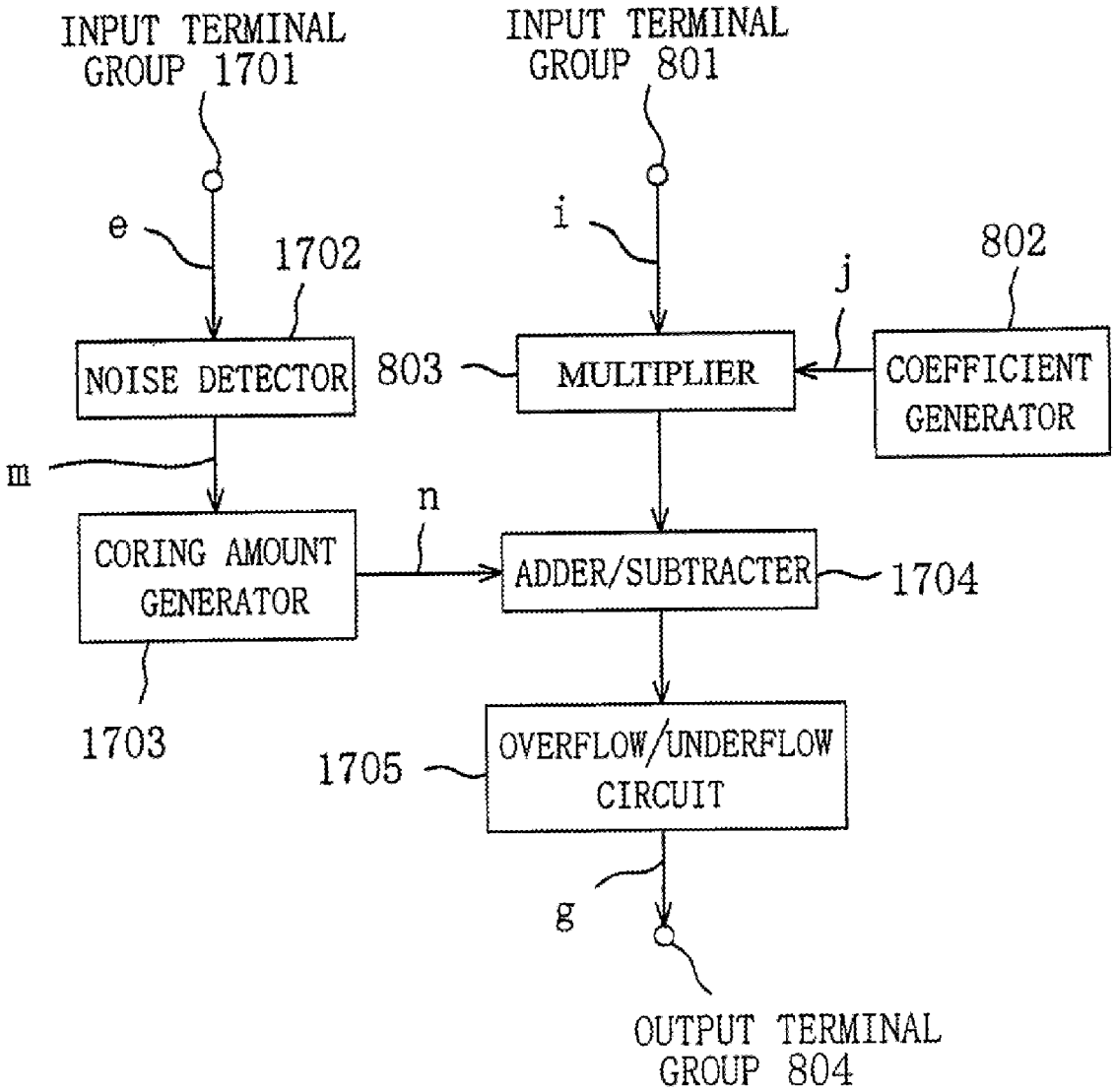

FIG. 3 is a diagrammatic illustration of the write operation of video data performed by the plasma addressed display apparatus of FIG. 2A, which is the same as the write operation performed by the plasma addressed display apparatus having the panel shown in FIG. 24. Therefore, the plasma addressed display apparatus of the present invention can write double the data amount compared with the conventional plasma addressed display apparatus having the panel shown in FIG. 22.

Figure 4:
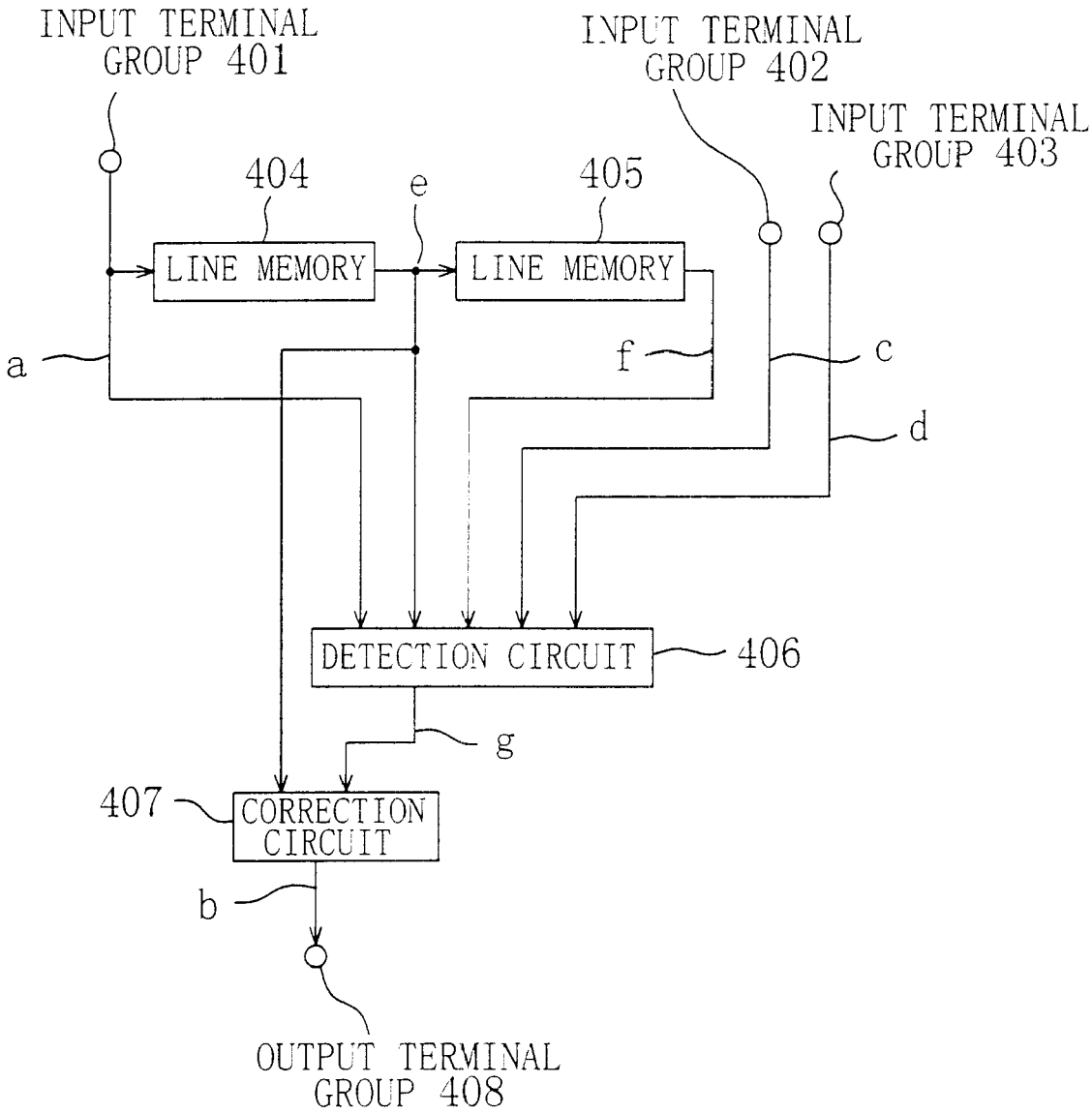
FIG. 4 is a block diagram of an interference detection correction circuit of the plasma addressed display apparatus according to the present invention.

FIG. 4 is a block diagram of the interference detection correction circuit 209 of the plasma addressed display apparatus shown in FIG. 2A. The interference detection correction circuit 209 includes input terminal groups 401, 402, and 403, line memories 404 and 405, a detection circuit 406, a correction circuit 407, and an output terminal group 408.

The input signal a, the vertical timing signal c, and the vertical display phase signal d are input via the input terminal groups 401, 402, and 403, respectively. Line memories 404 and 405 accumulate video data corresponding to one scanning period. The detection circuit 406 receives the input signal a via the input terminal group 401, a 1-line delay signal e output from the line memory 404, a 2-line delay signal f output from the line memory 405, the vertical timing signal c via the input terminal group 402, and the vertical display phase signal d via the input terminal group 403. The detection circuit 406 determines an interference correction signal g based on the received signals, and outputs it to the correction circuit 407. The correction circuit 407 receives the 1-line delay signal e and the interference correction signal g and outputs the corrected output signal b. The 1-line delay signal e and the 2-line delay signal f are signals delayed by one scanning period and two scanning periods, respectively, from the input signal a.

The plasma addressed display apparatus of the present invention is characterized in that the operations for the scanning lines are completed every two lines (complete processing). In other words, in the interference detection, operations are executed using only video data relating to the same plasma discharge channel. This complete processing will be described with reference to FIG. 3. Data D21, D22, D23, . . . are sequentially written in predetermined channels in synchronization with the sequential scanning. Assuming that D23 corresponds to the input signal a, D22 and D21 correspond to the 1-line delay signal e and the 2-line delay signal f, respectively. Table 1 below lists the line completion processing.

TABLE 1

| INPUT SIGNAL a | 1-LINE DELAY SIGNAL e | 2-LINE DELAY SIGNAL f |
|---|---|---|
| D23 | D22 | D21 |
| D24 | D23 | D22 |
| D25 | D24 | D23 |
| D26 | D25 | D24 |

CORRECTION OF D23 CORRECTION OF D24

The state described above corresponds to the first entry of Table 1. With the above signals obtained, the following operations are executed as interference correction. That is, the following equation is calculated for D23.

$$D23\text{new}=D23+KS*(D23-D24) \quad (1)$$

And, the following equation is calculated for D24.

$$D24\text{new}=D24+KS*(D24-D23) \quad (2)$$

The coefficient KS will be described later.

For the above operations, the signal e is used as the object to be corrected. In equation (1) above, while D24 is being input, D23 is obtained from the signal e and D24 is obtained from the signal a. D23 and D24 are subtracted and multiplied, and the resultant value is added to D23. In equation (2) above, while D25 is being input, D24 is obtained from the signal e and D23 is obtained from the signal f. D23 and D24 are subtracted and multiplied, and the resultant value is added to D24. Such processing where all data used for the operation belong to the same channel is called herein the complete processing.

The coefficient KS required for signal processing is obtained in the following manner. The brightness for video data changes due to interference between video data. In the following description, assume for simplification that the amount of the brightness change due to interference between data of LN0 and LN1 at panel display is proportional to the difference in level between the data of LN0 and LN1.

Assume that LN0 is the focusing scanning line and data of LN0 is to be corrected, and that LN1 is the scanning line immediately below LN0. The amount of interference at panel display is proportional to the level difference between the vertically adjacent data as assumed above. Therefore, the following equation is satisfied.

$$\text{Interference-induced change amount}=KP*(LN0-LN1) \quad (3)$$

wherein KP denotes the coefficient of interference at panel display.

In the signal processing for the data of LN0 and LN1, the correction amount is obtained by the following operation using the coefficient KS.

$$\text{Correction amount}=KS*(LN0-LN1) \quad (4)$$

By adding the above correction amount, data of LN0 and LN1 can be corrected according to the following equations.

$$LN0\text{new}=LN0+KS*(LN0-LN1) \quad (5)$$

$$LN1\text{new}=LN1+KS*(LN1-LN0) \quad (6)$$

The resultant corrected signals LN0new and LN1new are applied to the respective lines. The interference-induced change amount at panel display due to the level difference after the application of these corrected signals should be equal to the correction amount by the signal processing. That is, the following equation should be satisfied.

$$KS*(LN0-LN1)=KP*(LN0\text{new}-LN1\text{new}) \quad (7)$$

Thus, the relationship between KS and KP is as follows.

$$KS=KP/(1-2*KP) \quad (8)$$

KP is a value that can be obtained by measurement. In the case shown in FIG. 5A, the level difference between the upper and lower video data is obtained by calculating the difference between the data levels written in LN0 and LN1, i.e., 200−40=160. When the level difference is 160, the lowering in brightness due to interference (the brightness for data of LN0 lowers because LN0>LN1 is assumed in this case) is measured as 20. Therefore, from equation (3) above, the following is obtained.

$$KP = \text{interference-induced change amount}/(LN0 - LN1)$$
$$= 20/(200-40)$$
$$= 1/8$$

When KP is ⅛, the coefficient for correction operation, KS, is ⅙ from equation (8) above.

If KP is ½, no solution is given to equation (8). This appears contradictory at first sight. However, KP=½ indicates the state where LN0 and LN1 are made equal due to interference irrespective of the levels of LN0 and LN1. Such a state will never occur because the coefficient KP determined by the characteristics of the panel invariably falls within the range of 0<KP<½. Therefore, equation (8) is not contradictory.

In the above description, the interference-induced change amount was assumed to be proportional to the level difference between LN0 and LN1. In the plasma addressed display apparatus of the present invention, actually, this is not true. However, even when the interference-induced change amount and the level difference of data are in a nonlinear relationship, a coefficient KS corresponding to nonlinear characteristics can be obtained, and thus the above operations using the coefficient KS are still applicable.

Figure 5A:
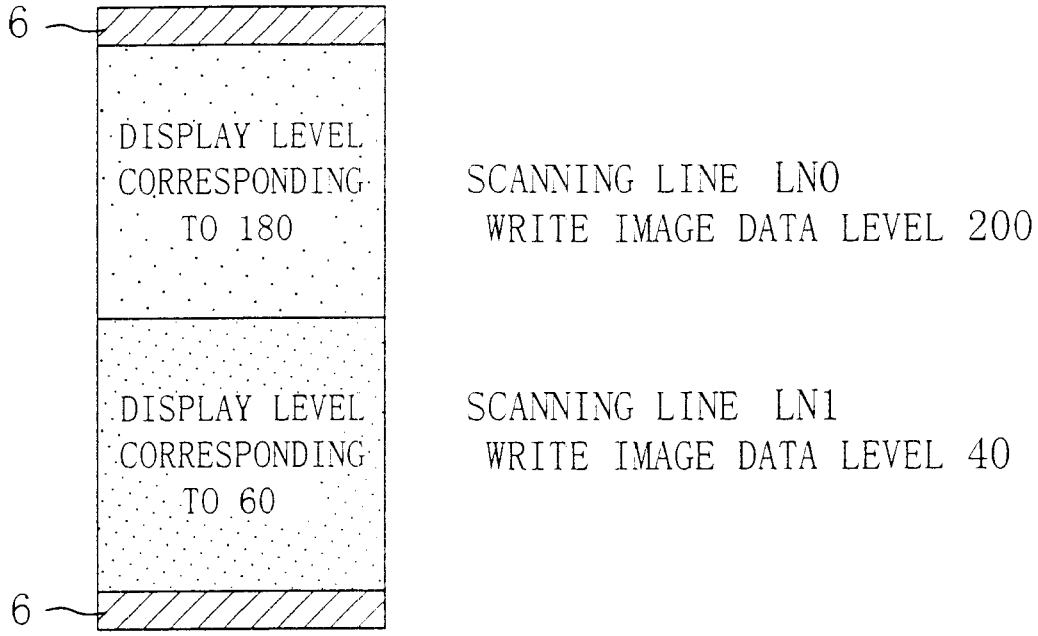
FIGS. 5A and 5B are diagrammatic illustrations of the operation of the interference detection correction circuit of the plasma addressed display apparatus according to the present invention.
Figure 5B:
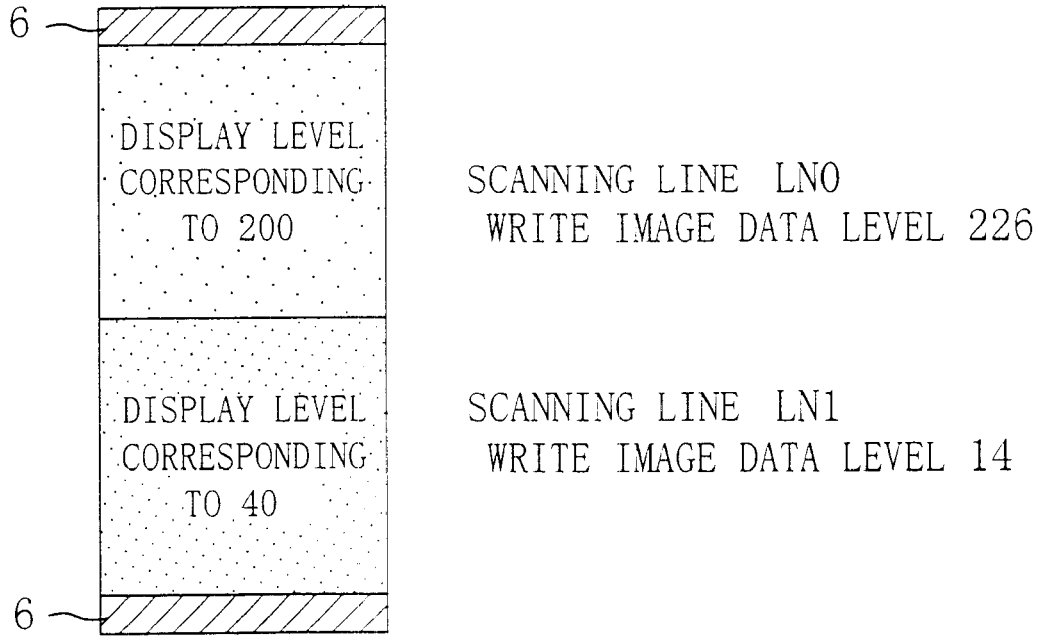

With reference to FIGS. 5A and 5B, the operation of the interference detection correction circuit 209 of the plasma addressed display apparatus of the present invention will be described. For simplification of description, FIGS. 5A and 5B show only one plasma discharge channel and one pixel. The coefficient KS required for operations is ⅙. This value was obtained from the above operations based on the amount of brightness change actually occurring on the panel when LN0=200 and LN1=40 were displayed.

In FIG. 5A, LN0=200 and LN1=40 are assumed. Since KS=⅙, the correction amount is calculated as follows from equation (4) above.

$$\text{Correction amount}=KS*(LN0-LN1)=26 \text{ (fractional portion dropped)}$$

Since LN0>LN1, $$LN0\text{new}=LN0+KS(LN0-LN1)=226$$

$$LN1\text{new}=LN1+KS(LN1-LN0)=14.$$

When the resultant LN0new and LN1new are displayed on the panel, the change amount due to interference is as follows.

$$\text{Interference-induced change amount}=KP*(LN0\text{new}-LN1\text{new})=26$$

Since LN0new>LN1new, the brightness for LN0new lowers by 26 while that of LN1new increases by 26. Therefore, the brightness on the display is as follows in terms of the video level.

$$LN0\text{new}=200$$

$$LN1\text{new}=40$$

In this way, the amount of brightness change due to interference is corrected.

Thus, as described above, in the plasma addressed display apparatus according to the present invention, the interference detection correction circuit 209 corrects video data by detecting a disturbance caused by mutual interference between scanning lines formed in the same plasma discharge channel based on the amplitudes of adjacent video data in the vertical direction. For the operations of this correction, a line memory is used as a means for accumulating video data for one scanning period. For the detection of correlation in the vertical direction, scanning lines in the same plasma discharge channel are used mutually, such as LN1 for LN0 and LN0 or LN1, in such a manner that the processing is completed within the plasma discharge channel.

Embodiment 2

Figure 6:
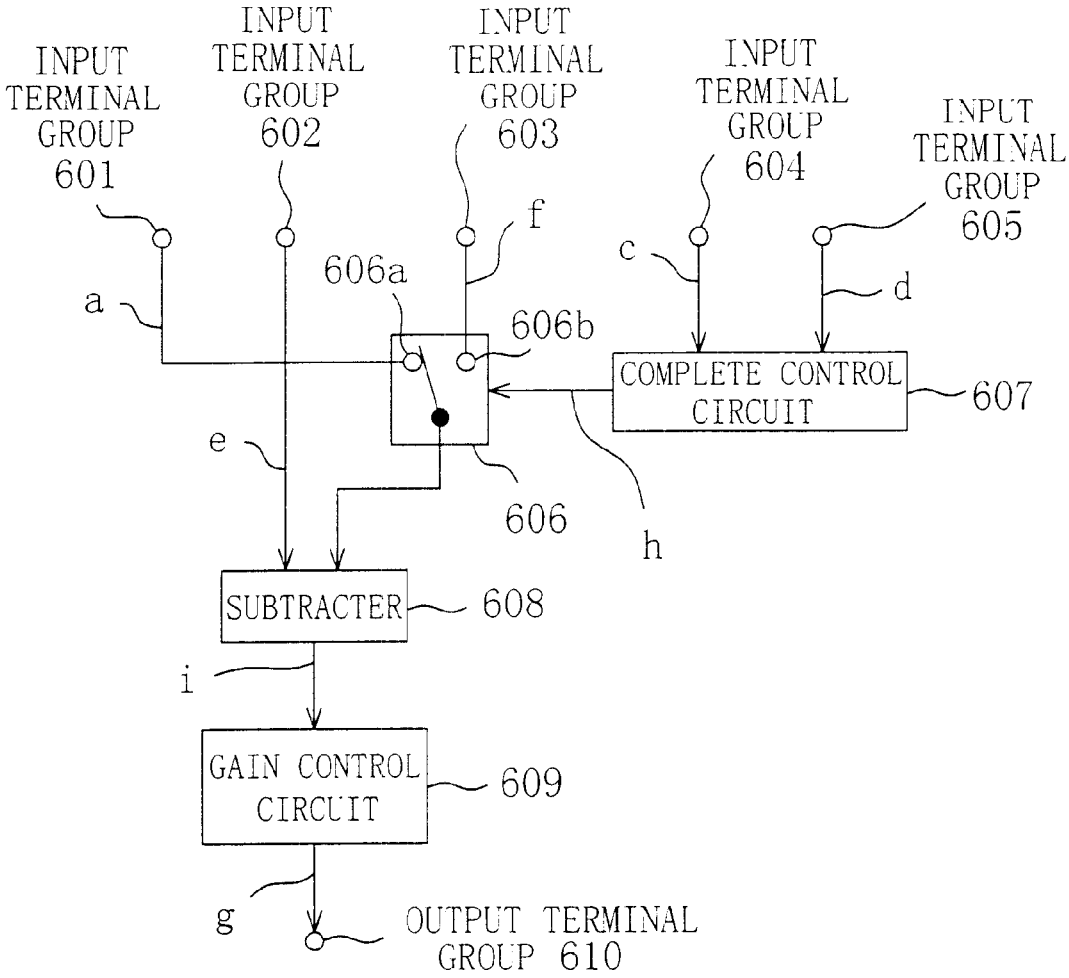
FIG. 6 is a block diagram of a detection circuit in EMBODIMENT 2 of the present invention.

FIG. 6 is a block diagram of the detection circuit 406 as an internal circuit of the interference detection correction circuit 209 of the plasma addressed display apparatus according to the present invention. Referring to FIG. 6, the detection circuit 406 includes input terminal groups 601, 602, 603, 604, and 605, a switch 606, a complete control circuit 607, a subtracter 608, a gain control circuit 609, and an output terminal group 610.

The switch 606 receives the input signal a via the input terminal group 601 at one contact 606*a* and the 2-line delay signal f via the input terminal group 603 at the other contact 606*b*. The switch 606 switches these two inputs every scanning period with a channel complete switch signal h received from the complete control circuit 607. The complete control circuit 607 receives the vertical timing signal c via the input terminal group 604 and the vertical display phase signal d via the input terminal group 605, and generates the channel complete switch signal h so that the processing by the detection circuit every scanning line can be completed within the same plasma discharge channel. The signal switched on by the switch 606 and the 1-line delay signal e from the input terminal group 602 are input into the subtracter 608 for subtraction. A differential signal i output from the subtracter 608 as the result of the subtraction represents a correlation component between the scanning lines in the same plasma discharge channel obtained from the amplitudes of the adjacent video data in the vertical direction. The differential signal i is input into the gain control circuit 609, which calculates an appropriate gain for the differential signal i and outputs the results via the output terminal group 610 as the interference correction signal g.

Figure 7:
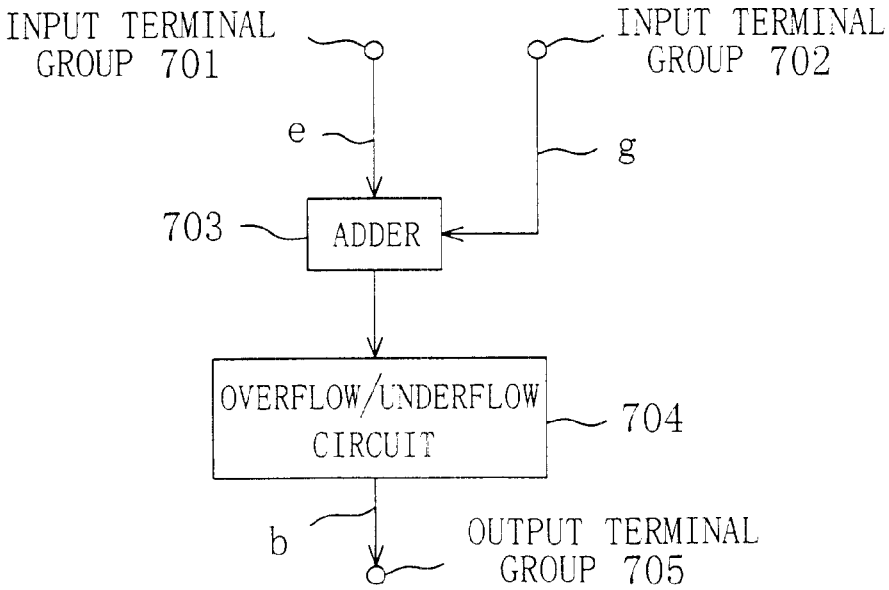
FIG. 7 is a block diagram of a correction circuit in EMBODIMENT 2 of the present invention.

FIG. 7 is a block diagram of the correction circuit 407 as another internal circuit of the interference detection correction circuit 209 of the plasma addressed display apparatus according to the present invention. Referring to FIG. 7, the correction circuit 407 includes input terminal groups 701 and 702, an adder 703, and an overflow/underflow circuit 704.

The adder 703 receives the 1-line delay signal e via the input terminal group 701 and the interference correction signal g via the input terminal group 702 for add operation.

The overflow/underflow circuit 704 executes overflow/underflow processing for the results output from the adder 703, and outputs the results via an output terminal group 705 as the corrected output signal b.

Figure 8:
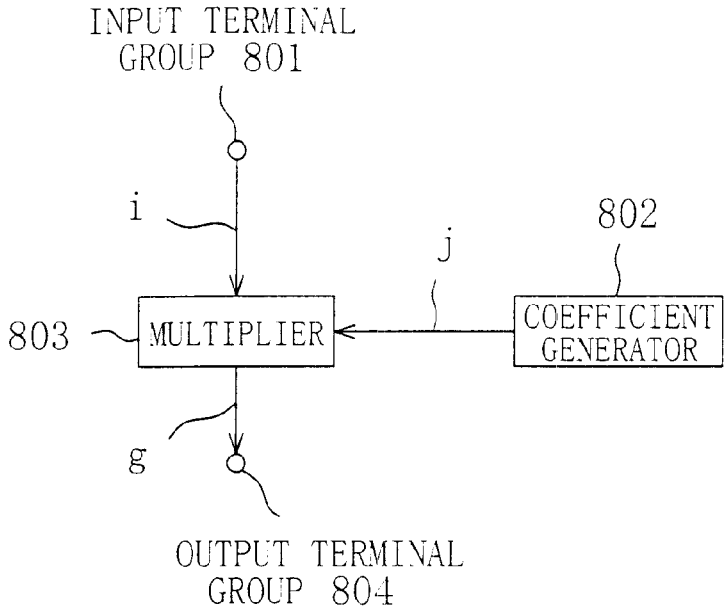
FIG. 8 is a block diagram of a gain control circuit in EMBODIMENT 2 of the present invention.

FIG. 8 is a block diagram of the gain control circuit 609 shown in FIG. 6. Referring to FIG. 8, the gain control circuit 609 includes an input terminal group 801, a coefficient generator 802, a multiplier 803, and an output terminal group 804.

The multiplier 803 receives an interference correction gain coefficient j from the coefficient generator 802 and the differential signal i via the input terminal group 801, executes multiplication, and outputs the results via the output terminal group 804 as the interference correction signal g. The interference correction gain coefficient j is a coefficient by which the differential signal i is multiplied so that the interference-induced change amount and the correction amount by the signal processing according to the present invention be identical to each other.

Figure 9:
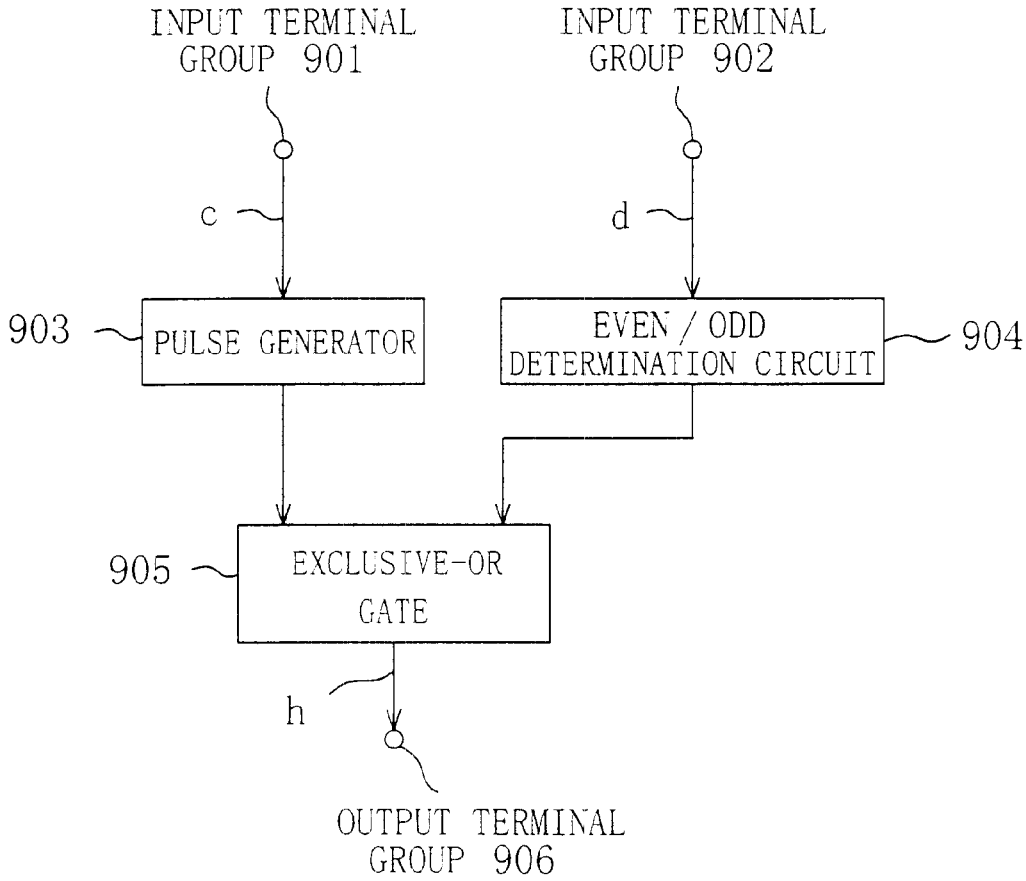
FIG. 9 is a block diagram of a completion control circuit in EMBODIMENT 2 of the present invention.

FIG. 9 is a block diagram of the complete control circuit 607 shown in FIG. 6. Referring to FIG. 9, the complete control circuit 607 includes input terminal groups 901 and 902, a pulse generator 903, an even/odd determination circuit 904, an exclusive-OR gate 905, and an output terminal group 906.

The pulse generator 903 generates a pulse signal repeating LOW and HIGH every scanning period using the vertical timing signal c received via the input terminal group 901 as a trigger. The even/odd determination circuit 904 determines whether the display phase is even or odd based on the vertical display phase signal d received via the input terminal group 902. For example, the even/odd determination circuit 904 examines the least significant bit (LSB) of the vertical display phase signal d and determines as "even" if it is "0" or "odd" if it is "1". In the case where the phase relationship between the vertical synchronous timing and the video data changes, the output of the pulse generator 903 will not be reliable any more and the phase for realizing processing within one channel will be shifted. As a result, data of scanning lines in different plasma discharge channels may be mutually used in the operation. In order to avoid this occurrence, exclusive-OR operation is done between the output from the pulse generator 903 and the output from the even/odd determination circuit 904, so as to ensure that the complete processing can be executed within the same plasma discharge channel without fail.

Table 2 below shows the correction characteristics used in the gain control circuit in EMBODIMENT 2.

TABLE 2

CORRECTION AMOUNT 29 WHEN LN0 = 47 AND LN1 = 223

| LN1 \ LN0 | 0 | 15 | 31 | 47 | 63 | 79 | 95 | 111 | 127 | 143 | 159 | 175 | 191 | 207 | 223 | 239 | 255 |
|---|---|---|---|---|---|---|---|---|---|---|---|---|---|---|---|---|---|
| 255 | 42 | 39 | 37 | 34 | 31 | 29 | 26 | 23 | 21 | 18 | 15 | 13 | 10 | 8 | 5 | 2 | 0 |
| 239 | 39 | 37 | 34 | 31 | 29 | 26 | 23 | 21 | 18 | 15 | 13 | 10 | 8 | 5 | 2 | 0 | 2 |
| 223 | 37 | 34 | 31 | 29 | 26 | 23 | 21 | 18 | 15 | 13 | 10 | 8 | 5 | 2 | 0 | 2 | 5 |
| 207 | 34 | 31 | 29 | 26 | 23 | 21 | 18 | 15 | 13 | 10 | 8 | 5 | 2 | 0 | 2 | 5 | 8 |
| 191 | 31 | 29 | 26 | 23 | 21 | 18 | 15 | 13 | 10 | 8 | 5 | 2 | 0 | 2 | 5 | 8 | 10 |
| 175 | 29 | 26 | 23 | 21 | 18 | 15 | 13 | 10 | 8 | 5 | 2 | 0 | 2 | 5 | 8 | 10 | 13 |
| 159 | 26 | 23 | 21 | 18 | 15 | 13 | 10 | 8 | 5 | 2 | 0 | 2 | 5 | 8 | 10 | 13 | 15 |
| 143 | 23 | 21 | 18 | 15 | 13 | 10 | 8 | 5 | 2 | 0 | 2 | 5 | 8 | 10 | 13 | 15 | 18 |
| 127 | 21 | 18 | 15 | 13 | 10 | 8 | 5 | 2 | 0 | 2 | 5 | 8 | 10 | 13 | 15 | 18 | 21 |
| 111 | 18 | 15 | 13 | 10 | 8 | 5 | 2 | 0 | 2 | 5 | 8 | 10 | 13 | 15 | 18 | 21 | 23 |
| 95 | 15 | 13 | 10 | 8 | 5 | 2 | 0 | 2 | 5 | 8 | 10 | 13 | 15 | 18 | 21 | 23 | 26 |
| 79 | 13 | 10 | 8 | 5 | 2 | 0 | 2 | 5 | 8 | 10 | 13 | 15 | 18 | 21 | 23 | 26 | 29 |
| 63 | 10 | 8 | 5 | 2 | 0 | 2 | 5 | 8 | 10 | 13 | 15 | 18 | 21 | 23 | 26 | 29 | 31 |
| 47 | 8 | 5 | 2 | 0 | 2 | 5 | 8 | 10 | 13 | 15 | 18 | 21 | 23 | 26 | 29 | 31 | 34 |
| 31 | 5 | 2 | 0 | 2 | 5 | 8 | 10 | 13 | 15 | 18 | 21 | 23 | 26 | 29 | 31 | 34 | 37 |
| 15 | 2 | 0 | 2 | 5 | 8 | 10 | 13 | 15 | 18 | 21 | 23 | 26 | 29 | 31 | 34 | 37 | 39 |
| 0 | 0 | 2 | 5 | 8 | 10 | 13 | 15 | 18 | 21 | 23 | 26 | 29 | 31 | 34 | 37 | 39 | 42 |

CORRECTION AMOUNT 5 WHEN LN0 = 127 AND LN1 = 95

Table 2 above specifically shows the characteristics obtained when the brightness change due to interference occurs at a rate of ⅛ of the difference between LN0 and LN1 and thus KS=⅙ is obtained from equation (8). The video data has a width of eight bits, and black corresponds to level 0 while white corresponds to level 255. In Table 2, the X-axis and Y-axis respectively represent LN0 and LN1 shown in FIGS. 5A and 5B, both with the scale of representative levels taken every 16 levels. The value at each intersection between the LN0 and LN1 levels indicates the absolute of the value of the interference correction signal g in EMBODIMENT 2.

For example, when LN0=127 and LN1=95, the correction value is 5 from the intersection of these values in Table 2. In this case, since LN0>LN1, the operations of [LN0+interference correction signal g] and [LN0−interference correction signal g] are executed by the correction circuit 407. LN0new=132 and LN1new=90 are obtained as the corrected output signal b, which are then displayed on the panel. At panel display, brightness change occurs due to interference as calculated by equation (3). Therefore, video data having brightness corresponding to 132−(132−90)/8=126 for LN0 and 90+(132−90)/8=95 for LN1 are actually displayed.

The original data of LN0 has a level of 127 while the corrected data displayed on the display panel has a brightness corresponding to level 126, resulting in a shift of level by 1. However, this shift corresponds to an error of 1 to 256 gray-scale levels, which will not cause any significant disturbance. This shift is caused by operation precision and can be eliminated by designing the circuit so as to enhance the operation precision. Meanwhile, the original data of LN1 has a level of 95 while the corrected data displayed on the display panel has a brightness corresponding to 95. This indicates that the correction is complete for LN1.

Also, for example, when LN0=47 and LN1=223, the correction value is 29 from the intersection of these values in Table 2. In this case, since LN0<LN1, the operations of [LN0−interference correction signal g] and [LN0+interference correction signal g] are executed by the correction circuit 407. LN0new=18 and LN1new=252 are obtained as the corrected output signal b, which are then displayed on the panel. At panel display, brightness change occurs due to interference as calculated by equation (3). Therefore, video data having brightness corresponding to 18−(18−252)/8=47 for LN0 and 252+(18−252)/8=222 for LN1 are displayed.

The original data for LN0 has a level of 47 while the corrected data displayed on the display panel has a brightness corresponding to 47. Meanwhile, the original data of LN1 has a level of 223 while the corrected data displayed on the display panel has a brightness corresponding to 222. These indicate that the correction is complete for LN0 and LN1.

Table 3 below shows another example of the correction characteristics used in the gain control circuit in EMBODIMENT 2.

TABLE 3

| LN1 | | | | | | | | | | | | | | | | | | |
|---|---|---|---|---|---|---|---|---|---|---|---|---|---|---|---|---|---|---|
| 255 | 31 | 29 | 27 | 25 | 23 | 21 | 19 | 17 | 15 | 13 | 11 | 9 | 7 | 5 | 3 | 1 | 0 | |
| 239 | 29 | 27 | 25 | 23 | 21 | 19 | 17 | 15 | 13 | 11 | 9 | 7 | 5 | 3 | 1 | 0 | 1 | |
| 223 | 27 | 25 | 23 | 21 | 19 | 17 | 15 | 13 | 11 | 9 | 7 | 5 | 3 | 1 | 0 | 1 | 3 | |
| 207 | 25 | 23 | 21 | 19 | 17 | 15 | 13 | 11 | 9 | 7 | 5 | 3 | 1 | 0 | 1 | 3 | 5 | |
| 191 | 23 | 21 | 19 | 17 | 15 | 13 | 11 | 9 | 7 | 5 | 3 | 1 | 0 | 1 | 3 | 5 | 7 | |
| 175 | 21 | 19 | 17 | 15 | 13 | 11 | 9 | 7 | 5 | 3 | 1 | 0 | 1 | 3 | 5 | 7 | 9 | |
| 159 | 19 | 17 | 15 | 13 | 11 | 9 | 7 | 5 | 3 | 1 | 0 | 1 | 3 | 5 | 7 | 9 | 11 | |
| 143 | 17 | 15 | 13 | 11 | 9 | 7 | 5 | 3 | 1 | 0 | 1 | 3 | 5 | 7 | 9 | 11 | 13 | |
| 127 | 15 | 13 | 11 | 9 | 7 | 5 | 3 | 1 | 0 | 1 | 3 | 5 | 7 | 9 | 11 | 13 | 15 | |
| 111 | 13 | 11 | 9 | 7 | 5 | 3 | 1 | 0 | 1 | 3 | 5 | 7 | 9 | 11 | 13 | 15 | 17 | |
| 95 | 11 | 9 | 7 | 5 | 3 | 1 | 0 | 1 | 3 | 5 | 7 | 9 | 11 | 13 | 15 | 17 | 19 | |
| 79 | 9 | 7 | 5 | 3 | 1 | 0 | 1 | 3 | 5 | 7 | 9 | 11 | 13 | 15 | 17 | 19 | 21 | |
| 63 | 7 | 5 | 3 | 1 | 0 | 1 | 3 | 5 | 7 | 9 | 11 | 13 | 15 | 17 | 19 | 21 | 23 | |
| 47 | 5 | 3 | 1 | 0 | 1 | 3 | 5 | 7 | 9 | 11 | 13 | 15 | 17 | 19 | 21 | 23 | 25 | |
| 31 | 3 | 1 | 0 | 1 | 3 | 5 | 7 | 9 | 11 | 13 | 15 | 17 | 19 | 21 | 23 | 25 | 27 | |
| 15 | 1 | 0 | 1 | 3 | 5 | 7 | 9 | 11 | 13 | 15 | 17 | 19 | 21 | 23 | 25 | 27 | 29 | |
| 0 | 0 | 1 | 3 | 5 | 7 | 9 | 11 | 13 | 15 | 17 | 19 | 21 | 23 | 25 | 27 | 29 | 31 | |
| | 0 | 15 | 31 | 47 | 63 | 79 | 95 | 111 | 127 | 143 | 159 | 175 | 191 | 207 | 223 | 239 | 255 | LN0 |

When video data of LN0=200 and LN1=40 are displayed on the panel without interference correction, LN0 may have a brightness corresponding to only level 184 while LN1 may have a brightness as high as level 56. In such a case, it is calculated from equation (3) that the brightness change due to interference has occurred at a rate of 1/10 of the level difference between LN0 and LN1. Therefore, the correction coefficient KS is 1/8 from equation (8). Table 3 shows the correction characteristics obtained in such a case.

As described above, the interference detection correction circuit 209 of the plasma addressed display apparatus of EMBODIMENT 2 detects the amount of brightness change due to interference at display from the differential signal indicating the difference between video data that are in the same plasma discharge channel and adjacent in the vertical direction. A line memory is provided for obtaining video data adjacent in the vertical direction. The detection using the differential signal is completed within the same plasma discharge channel by using the switch 606. The complete control circuit 607 controls this complete processing, preventing the phase from shifting during vertical scrolling of the display screen and the like. The gain control circuit 609 provides an optimal gain to the differential signal. The correction amount output from the gain control circuit 609 is added to the 1-line delay signal for effecting correction.

Embodiment 3

Figure 10:
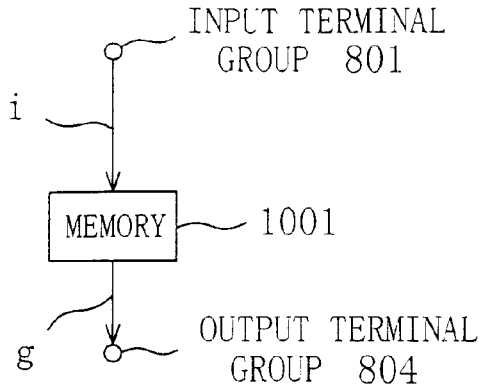
FIG. 10 is a block diagram of a gain control circuit in EMBODIMENT 3 of the present invention.

FIG. 10 is a block diagram of another construction of the gain control circuit 609 as EMBODIMENT 3 of the present invention, which is different from that in EMBODIMENT 2 shown in FIG. 8. In FIG. 10, the same components are denoted by the same reference numerals. The gain control circuit 609 in this embodiment includes an input terminal group 801, a memory 1001, and an output terminal group 804. In this embodiment, the memory 100 takes over the processing that is performed by the coefficient generator 802 and the multiplier 803 in EMBODIMENT 2, with operation characteristics being pre-loaded in the memory 1001.

The memory 1001 receives the differential signal i via the input terminal group 801 for correction multiplication, executes batch multiplication by a memory lookup table method, and outputs the results via the output terminal group 804 as the interference correction signal g. The memory lookup table method is a method where results of multiplication of presumed values of the differential signal i by a coefficient are pre-loaded in the memory 1001 with the presumed values being accessible as addresses, and when the actual differential signal i is input, the corresponding multiplied result is retrieved from the memory 1001.

As described above, in EMBODIMENT 3, the gain control processing for the differential signal i is performed by batch operation employing the memory lookup table method with the operation characteristics being pre-loaded in the memory. EMBODIMENT 3 therefore realizes the function of executing the same complicate operations as those realized by EMBODIMENT 2 at lower cost, at higher speed, and with improved operation precision.

Embodiment 4

Figure 11:
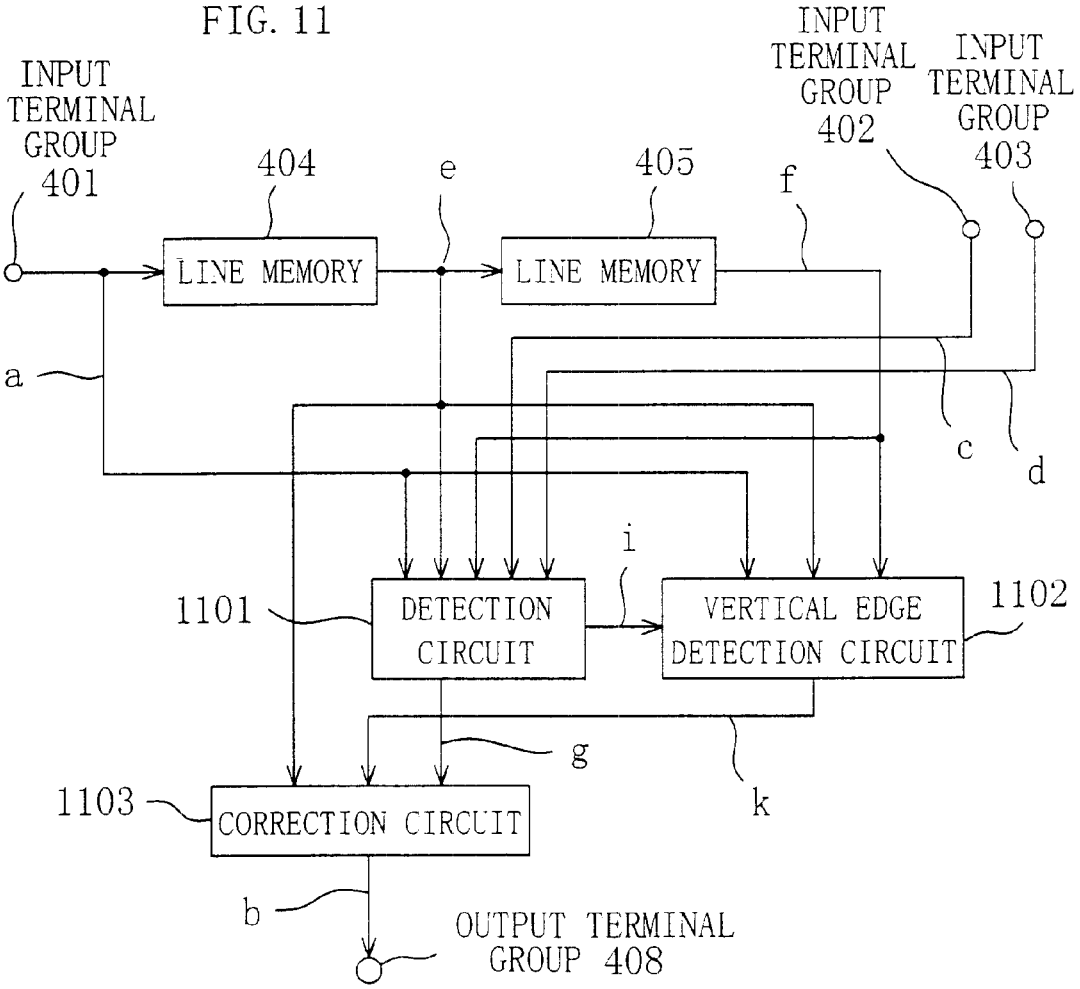
FIG. 11 is a block diagram of an interference detection correction circuit in EMBODIMENT 4 of the present invention.

FIG. 11 is a block diagram of another construction of the interference detection correction circuit 209 as EMBODIMENT 4 of the present invention. In FIG. 11, the same components as those in FIG. 4 are denoted by the same reference numerals. The interference detection correction circuit 209 in this embodiment includes input terminal groups 401, 402, and 403, line memories 404 and 405, a detection circuit 1101, a vertical edge detection circuit 1102, a correction circuit 1103, and an output terminal group 408. The construction shown in FIG. 11 is characterized in that the vertical high frequency compensation function is newly provided by the addition of the vertical edge detection circuit 1102 to the construction of FIG. 4. The detection circuit 1101 and the correction circuit 1103 in this embodiment shown in FIG. 11 have different constructions from those of the detection circuit 406 and the correction circuit 407 shown in FIG. 4.

Referring to FIG. 11, the detection circuit 1101 calculates input signals to output an interference correction signal g to the correction circuit 1103 and a differential signal i to the vertical edge detection circuit 1102. The vertical edge detection circuit 1102 receives the input signal a, the 1-line delay signal e, the 2-line delay signal f, and the differential signal i, and outputs a vertical high frequency signal k. The correction circuit 1103 receives the 1-line delay signal e, the interference correction signal g, and the vertical high signal k, executes interference correction and vertical high frequency correction, and outputs a corrected output signal b.

Figure 12:
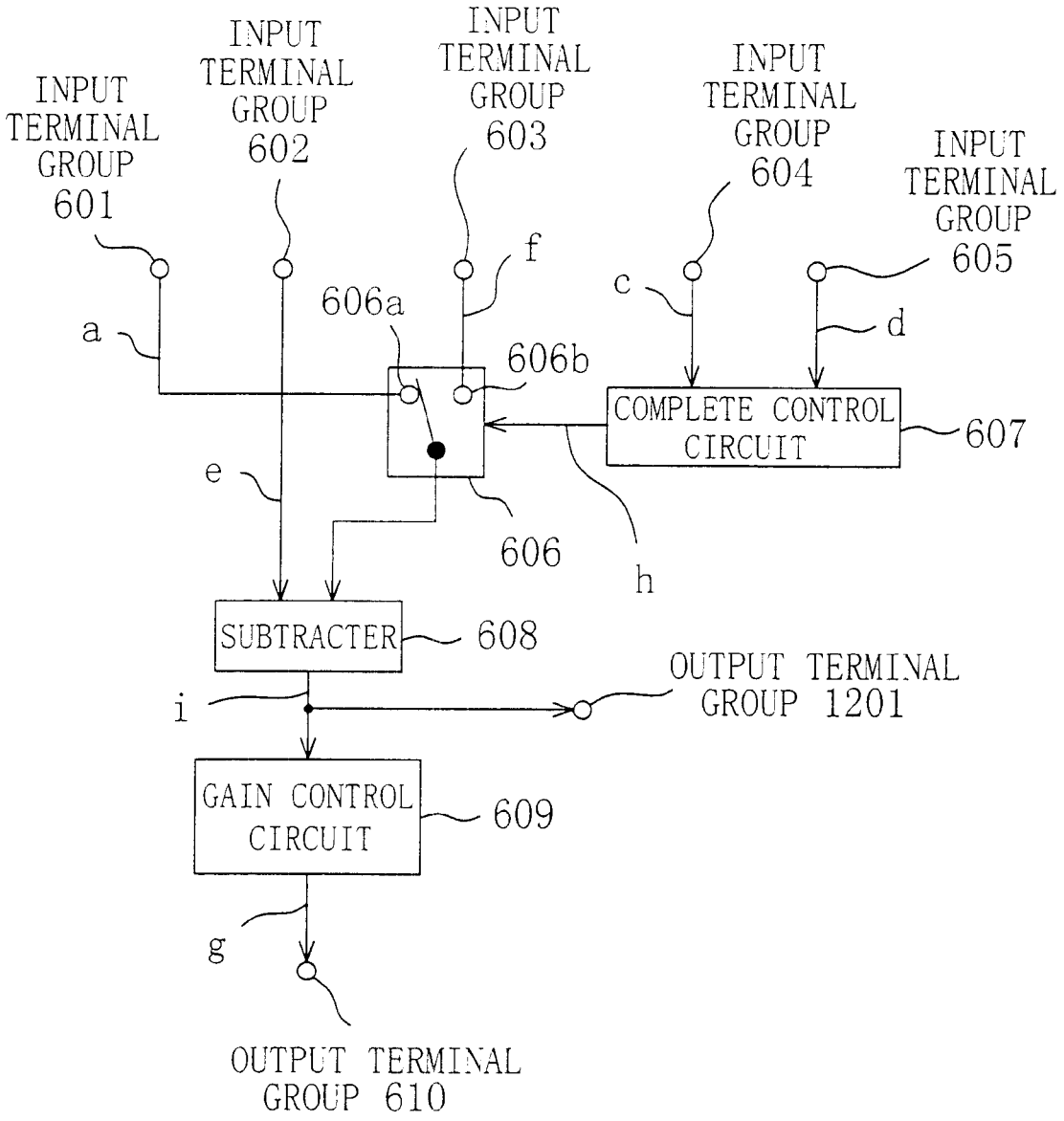
FIG. 12 is a block diagram of a detection circuit in EMBODIMENT 4 of the present invention.

FIG. 12 is a block diagram of the detection circuit 1101 shown in FIG. 11. In FIG. 12, the same components as those shown in FIG. 6 are denoted by the same reference numerals. The construction of FIG. 12 is different from that of FIG. 6 in that the differential signal i obtained by the subtracter 608 is output to an output terminal group 1201. The differential signal i is supplied via the output terminal group 1201 to the vertical edge detection circuit 1102.

Figure 13:
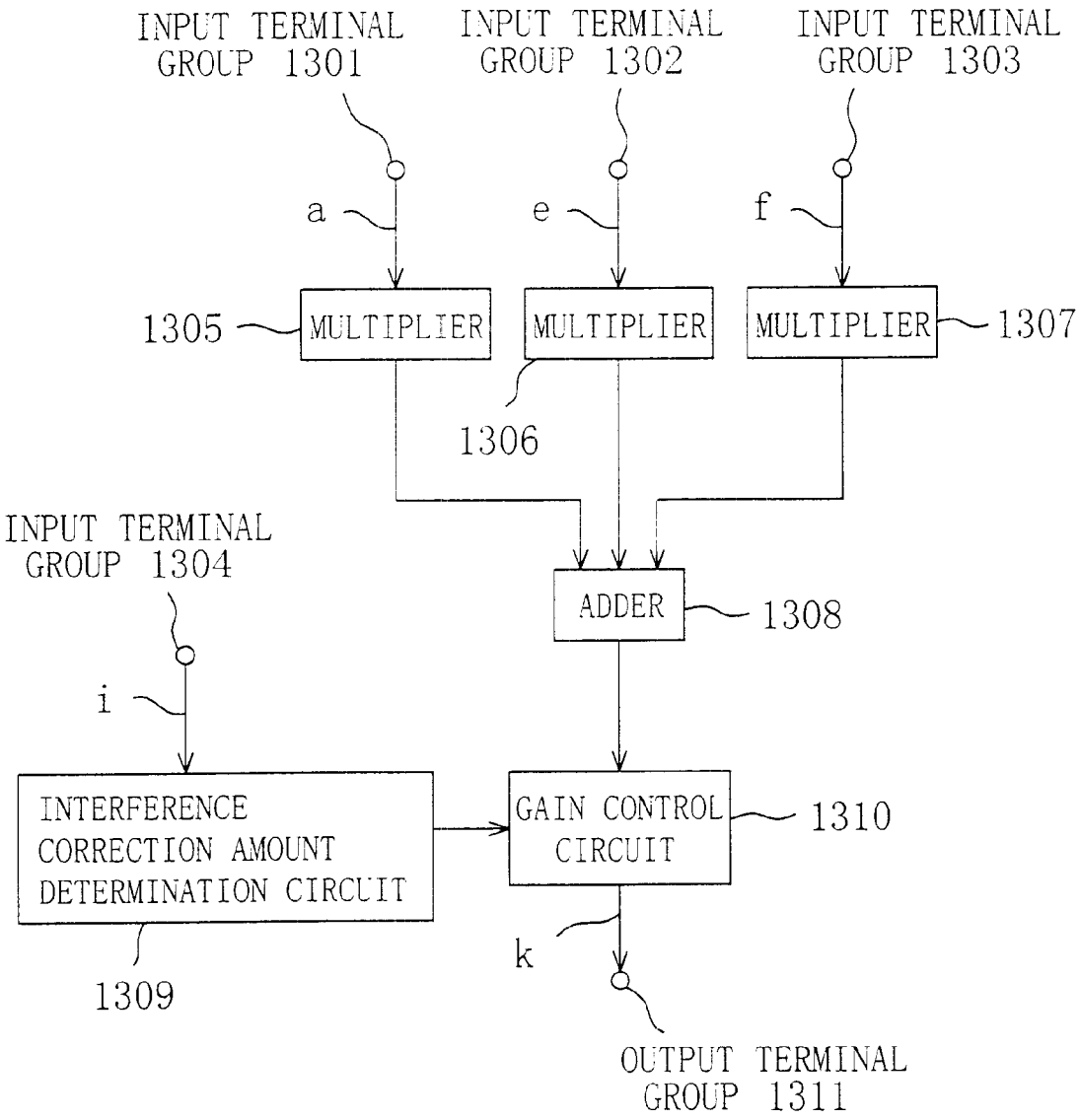
FIG. 13 is a block diagram of a vertical edge detection circuit in EMBODIMENT 4 of the present invention.

FIG. 13 is a block diagram of the vertical edge detection circuit 1102 shown in FIG. 11. Referring to FIG. 13, the vertical edge detection circuit 1102 includes input terminal groups 1301, 1302, 1303, and 1304, the multipliers 1305, 1306, and 1307, an adder 1308, an interference correction amount determination circuit 1309, a gain control circuit 1310, and an output terminal group 1311.

The vertical edge detection circuit 1102 receives the input signal a, the 1-line delay signal e, and the 2-line delay signal f, and executes operations based on these signals. Specifically, the multipliers 1305 and 1307 multiply the respecitve input signals by −¼, and multiplier 1306 multiplies the input signal by ½. These operations may be implemented by a multiplier or by bit shifting. The adder 1308 sums the results of these operations. That is, equation (9) below is calculated.

$$\text{Vertical high frequency component} = \tfrac{1}{2}*(\text{signal } e) - \tfrac{1}{4}*(\text{signal } a) - \tfrac{1}{4}*(\text{signal } f) \quad (9)$$

Equation (9) is generally used for a digital filter. The resultant vertical high frequency component is given a gain by the gain control circuit 1310. The gain is given by, for example, multiplying the component by ½, to obtain the vertical high frequency signal k. This operation is represented by equation (10) below.

$$\text{Vertical high frequency signal } k = \tfrac{1}{2}*(\text{vertical high frequency component}) \quad (10)$$

The gain of ½ is used in the gain control circuit 1310. Alternatively, it may be ¼, for example. The gain may be changeable externally within the range of 0 to 1, for example, depending on the preference of the viewer of the plasma addressed display apparatus.

Figure 14:
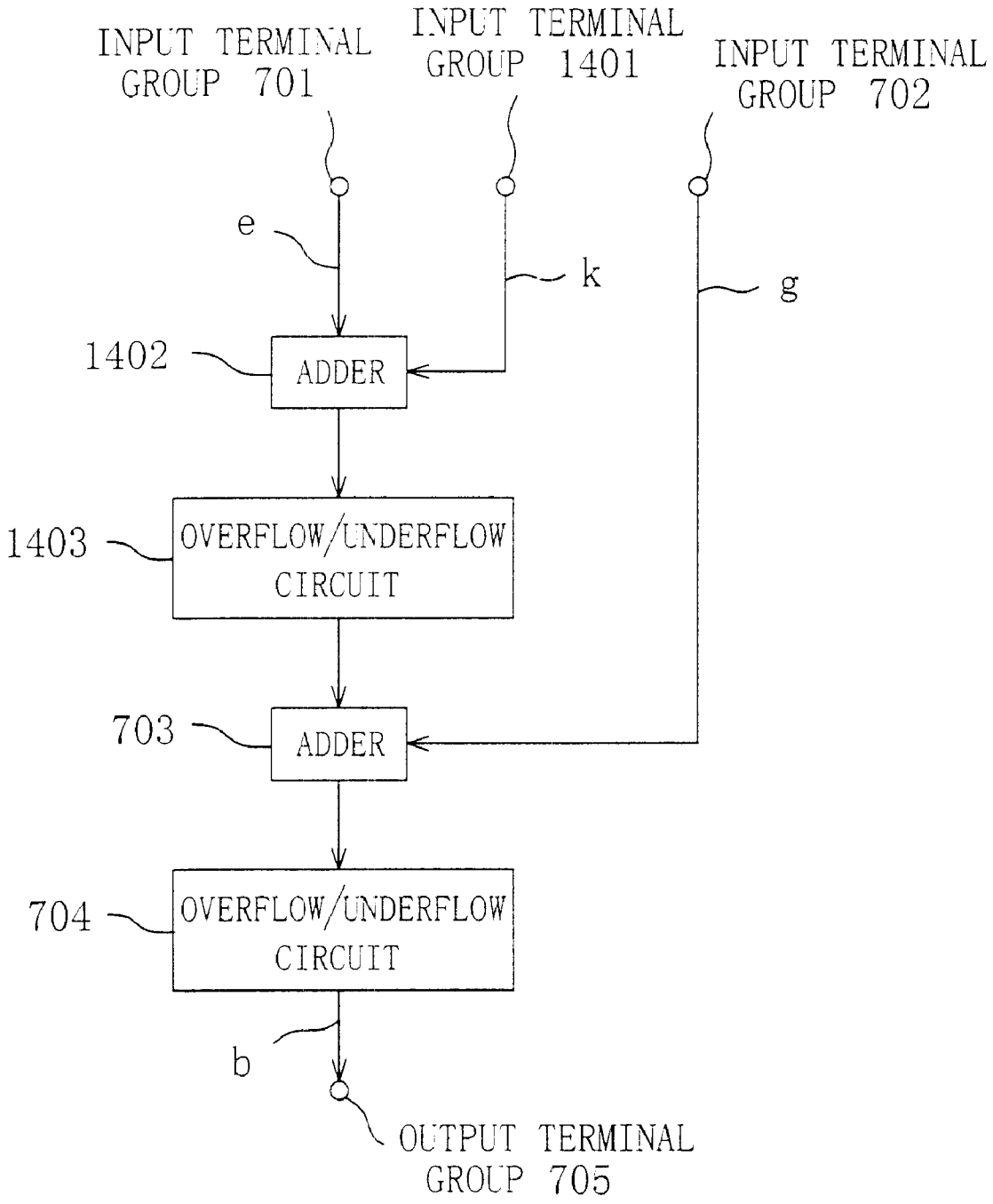
FIG. 14 is a block diagram of a correction circuit in EMBODIMENT 4 of the present invention.

FIG. 14 is a block diagram of the correction circuit 1103 shown in FIG. 11. The correction circuit 1103 includes input terminal groups 701, 702, and 1401, adders 703 and 1402, overflow/underflow circuits 704 and 1403, and an output terminal group 705. In FIG. 14, the same components as those in FIG. 7 are denoted by the same reference numerals.

The construction of FIG. 14 is different from that of FIG. 7 in that the adder 1402 adds the vertical high frequency signal k to the 1-line delay signal e that is the object to be corrected and that the overflow/underflow circuit 1403 executes overflow/underflow processing for the resultant signal. After the above processing, the adder 703 and the overflow/underflow circuit 704 execute interference correction processing as are done by those shown in FIG. 7.

An important point in this embodiment is the relationship between the interference correction and the gain used in the gain control circuit 1310. When a vertical high frequency component is compensated, the degree of interference tends to increase. It is preferable to avoid the increase in the degree of interference in consideration of the dynamic range. If the degree of interference correction is high, that is, if the absolute of the differential signal i is great, the gain for vertical high frequency compensation used in the gain control circuit should preferably be lowered from a value normally used. For this purpose, the differential signal i output from the detection circuit 1101 is supplied via the input terminal group 1304 to the interference correction amount determination circuit 1309, which controls the gain control circuit 1310 depending on the value of the differential signal 1.

Figure 15A:
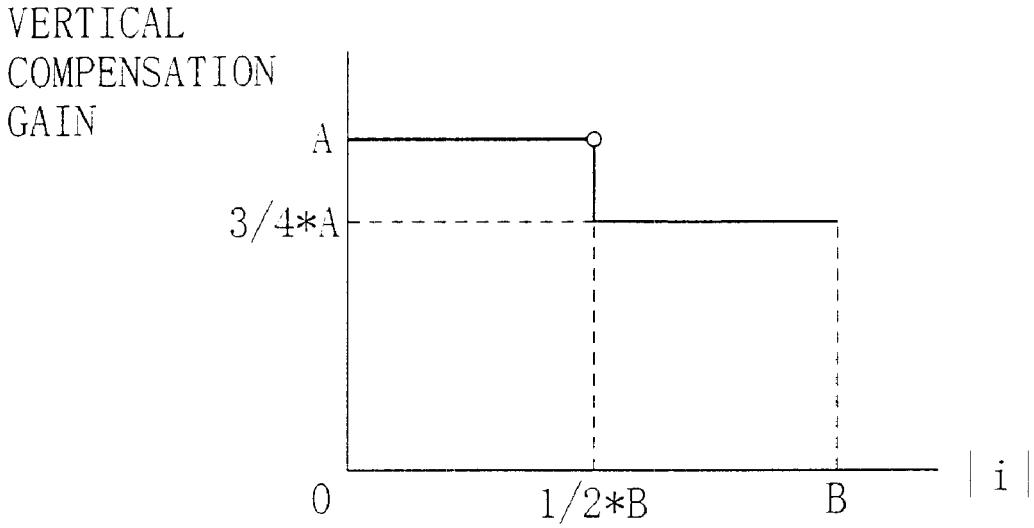
FIGS. 15A and 15B are graphs showing the relationship between the absolute of a differential signal and the vertical compensation gain.
Figure 15B:
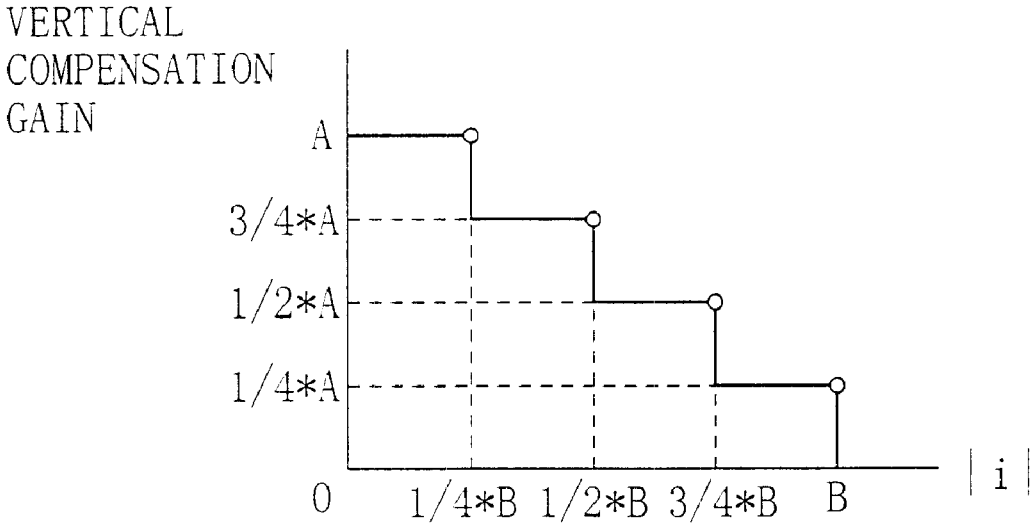

FIGS. 15A and 15B are graphs showing the relationship between the absolute of the differential signal i and the characteristics of the gain control circuit 1310. In FIG. 15A, the gain is set at A when the absolute of i is less than ½*B and is lowered to ¾*A when it becomes ½*B or more. This prevents breaking of an image that may otherwise occur due to double processing of the interference correction and the vertical high frequency compensation. FIG. 15B shows another example of the relationship between the absolute of the differential signal i and the characteristics of the gain control circuit 1310.

In EMBODIMENT 4, the line memories of the interference detection correction circuit 209 are also used for the vertical high frequency gain compensation, so that the circuit for the vertical high frequency gain compensation is realized by only slightly increasing the circuit scale. The gain for vertical high frequency compensation is controlled depending on the value of the differential signal representing the degree of interference. Thus, the vertical high frequency compensation, in combination with the interference compensation, realizes optimal compensation characteristics.

Embodiment 5

Figure 16:
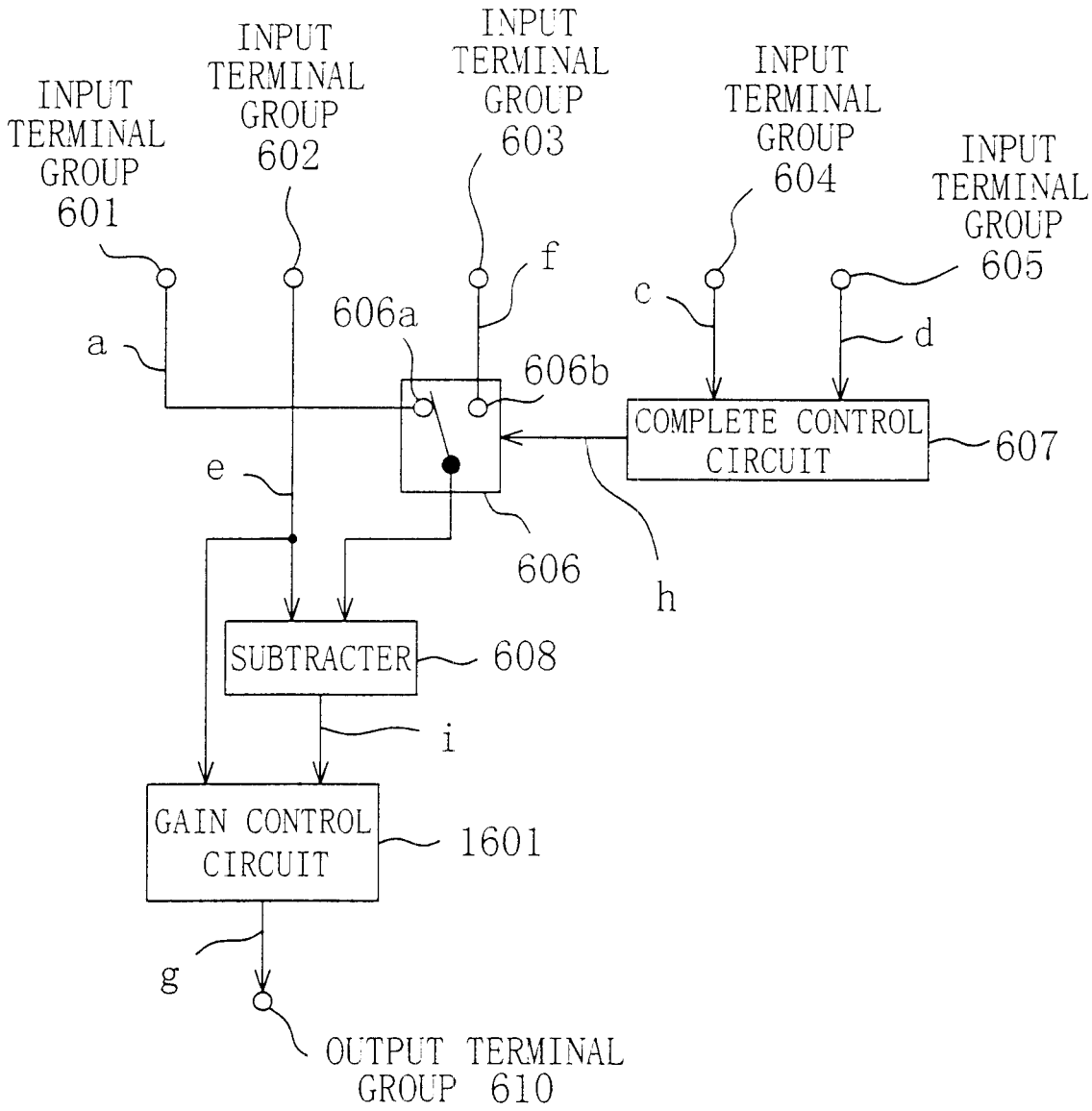
FIG. 16 is a block diagram of a detection circuit in EMBODIMENT 5 of the present invention.

FIG. 16 is a block diagram of another construction of the detection circuit 406 as EMBODIMENT 5 of the present invention. In FIG. 16, the same components as those in FIG. 6 are denoted by the same reference numerals. The construction of FIG. 16 is different from that of FIG. 6 in that the 1-line delay signal e is input into a gain control circuit 1601. The gain control circuit 1601 therefore receives the signal e and the differential signal i for setting a gain for interference correction.

Figure 17:
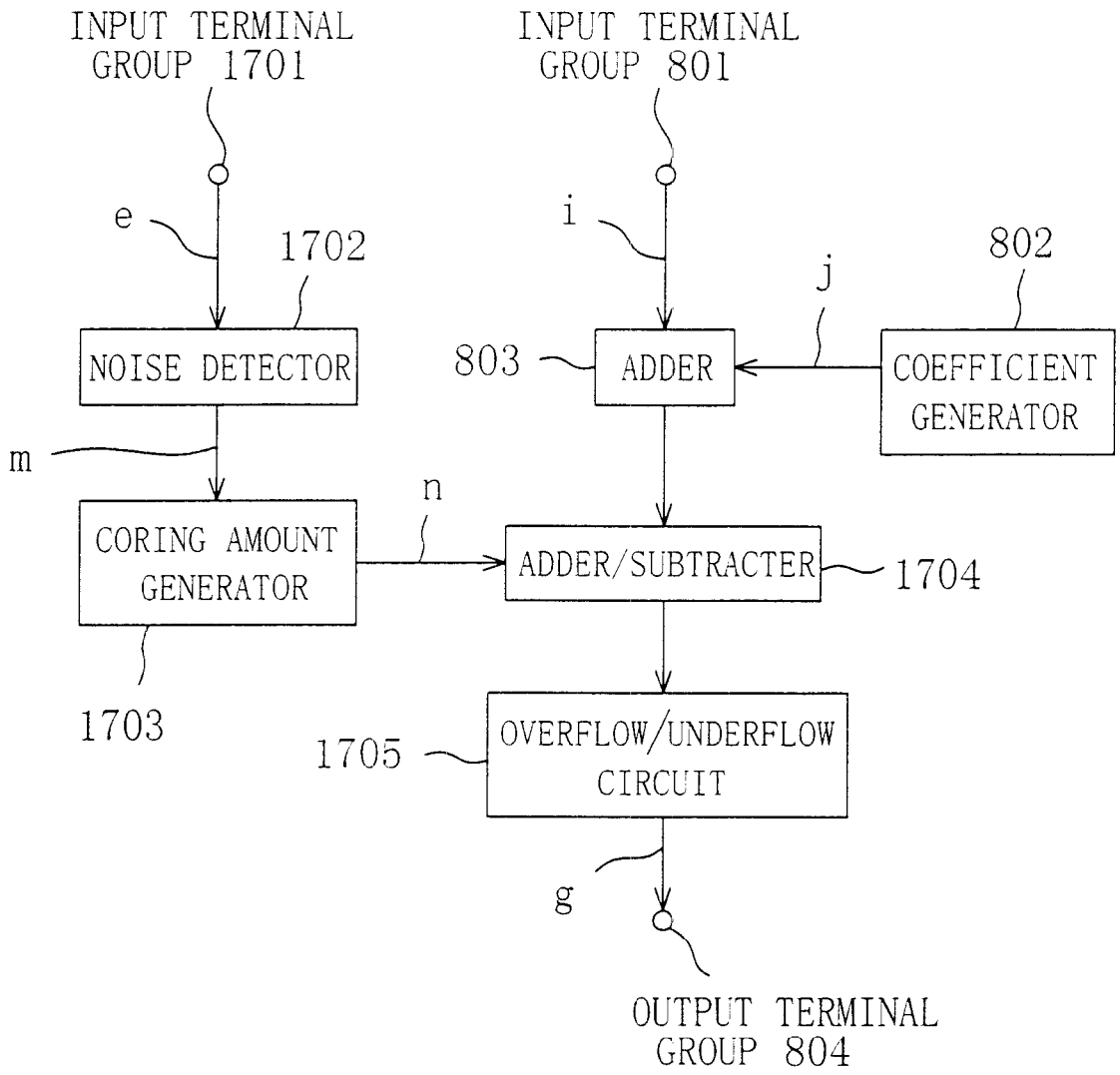
FIG. 17 is a block diagram of a gain control circuit in EMBODIMENT 5 of the present invention.

FIG. 17 is a block diagram of the gain control circuit 1601 shown in FIG. 16. In FIG. 17, the same components as those in FIG. 8 are denoted by the same reference numerals. The gain control circuit 1601 includes an input terminal group 1701, a noise detector 1702, a coring amount generator 1703, an adder/subtracter 1704, and an overflow/underflow circuit 1705, in addition to the input terminal group 801, the coefficient generator 802, the multiplier 803, and the output terminal group 804.

The noise detector 1702 detects a noise amount m of a video signal from the 1-line delay signal e supplied via the input terminal group 1701. For example, the noise detector 1702 detects the noise amount m of a video signal by integrating a variation in a fixed level signal portion of a horizontal blank section of the video data. The noise amount m is supplied to the coring amount generator 1703, which in turn outputs a coring amount n suitable for the noise amount m. Herein, the noise amount is defined as an index of the signal-to-noise ratio (S/N) of an image, and the coring amount is defined as an amount of a fraction of the interference correction signal g cancelled as noise.

Figure 18A:
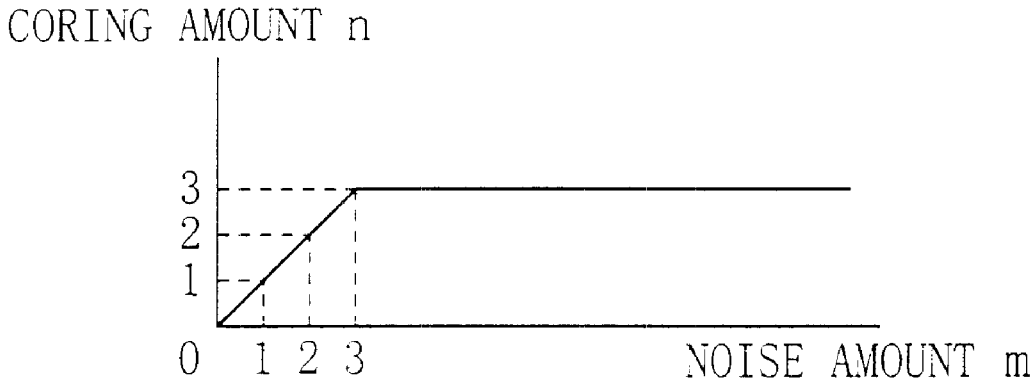
FIGS. 18A and 18B are graphs showing the relationship between the noise amount and the coring amount.
Figure 18B:
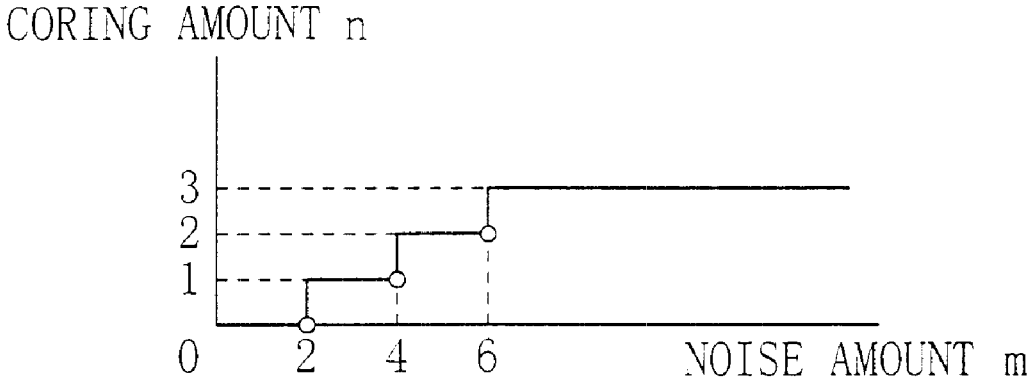

FIGS. 18A and 18B are graphs showing the relationship between the noise amount m and the coring amount n. The characteristics of the coring amount generator 1703 will be described with reference to FIGS. 18A and 18B. The noise detector 1702 increases the noise amount m when image data has much noise and the S/N is low, while decreasing it when the S/N is high. In FIG. 18A, the coring amount n is determined based on the noise amount m from the noise detector 1702 such that n=0 if m=0, n=1 if m=1, n=2 if m=2, and n=3 if m is 3 or more. The relationship shown in FIG. 18B may also be used. The coring amount n generated by the coring amount generator 1703 and the output from the multiplier 803 are input into the adder/subtracter 1704 for coring processing. The overflow/underflow circuit 1705 performs overflow/underflow processing for the output from the adder/subtracter 1704 and outputs the interference correction signal g via the output terminal group 804.

Figure 19A:
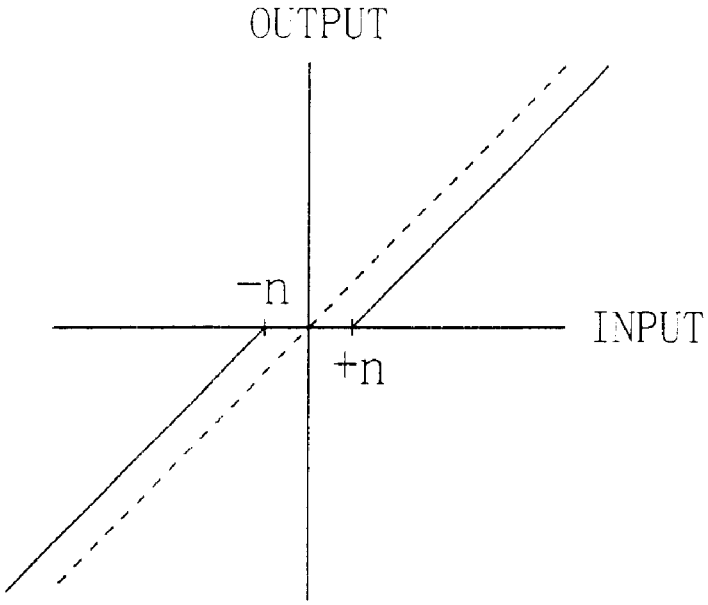
FIGS. 19A and 19B are graphs illustrating the characteristics of an adder/subtracter and an overflow/underflow circuit in EMBODIMENT 5 of the present invention.
Figure 19B:
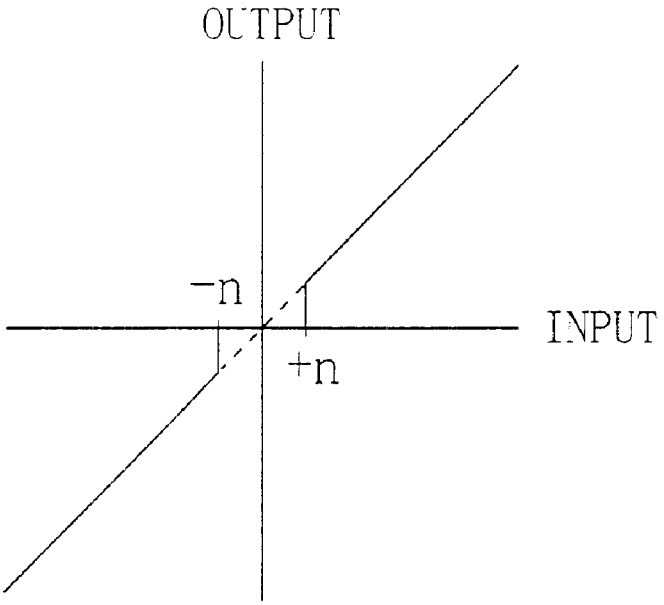

FIGS. 19A and 19B are graphs presented for understanding of the characteristics of the overflow/underflow circuit 1705. In the graphs, the dotted line represents the value output from the multiplier 803, and the solid line represents the value output via the output terminal group 804 as the interference correction signal g. In FIG. 19A, when the output of the multiplier 803 is a positive number, the coring amount n is subtracted from the output value. If the subtracted result is a negative number, it is clipped to be zero by the overflow/underflow circuit 1705. When the output of the multiplier 803 is a negative number, the coring amount n is added to the output value. If the added result is a positive number, it is clipped to be zero by the overflow/underflow circuit 1705. By this coring processing, the fraction of the output of the multiplier 803 becomes zero, so that an influence of noise on the corrected video signal can be eliminated. In place of the above processing by the adder/subtracter 1704 and the overflow/underflow circuit 1705 shown in FIG. 17, processing as shown in FIG. 19B may be adopted where a fraction below the coring amount n is compulsorily made zero. In this case, also, substantially the same effect can be obtained.

In EMBODIMENT 5, the detection circuit 406 includes the circuit for reducing noise of the detected component. Therefore, the display image will not be broken even when the S/N of video data is low. The noise reducing circuit controls the noise reduction amount depending on the noise level of the video data, whereby the noise reduction precision improves.

Embodiment 6

Figure 20:
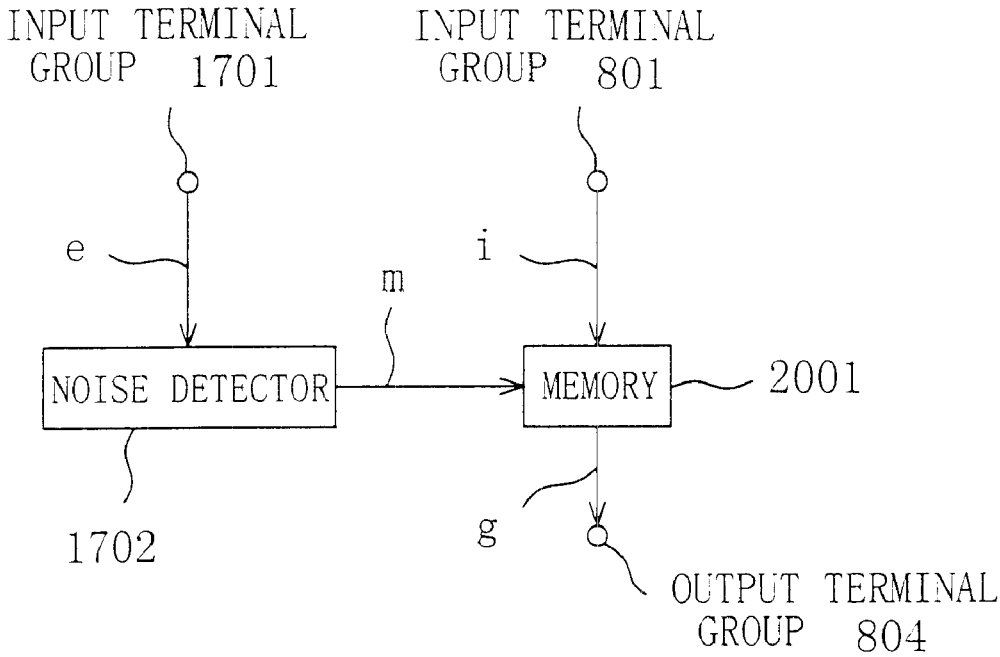
FIG. 20 is a block diagram of a gain control circuit in EMBODIMENT 6 of the present invention.

FIG. 20 is a block diagram of another construction of the gain control circuit 1601 as EMBODIMENT 6 of the present invention, which is different from that in EMBODIMENT 5 shown in FIG. 17. In FIG. 20, the same components as those in FIG. 17 are denoted by the same reference numerals. The gain control circuit in this embodiment includes input terminal groups 801 and 1701, a noise detector 1702, a memory 2001, and an output terminal group 804. In this embodiment, the coefficient generator 802, the multiplier 803, the coring amount generator 1703, the adder/subtracter 1704, and the overflow/underflow circuit 1705 in FIG. 17 are replaced with the memory 2001 with the operation characteristics being pre-loaded in the memory 2001.

The memory 2001 receives the differential signal i via the input terminal group 801 for correction multiplication, executes the multiplication, the coring processing, and the overflow/underflow processing by batch operation employing the memory lookup table method described above, and outputs the results via the output terminal group 804 as the interference correction signal g.

As described above, in EMBODIMENT 6, the operation characteristics for the gain control of the differential signal i, the coring processing, and the overflow/underflow processing have been pre-loaded in the memory, to allow for batch operation employing the memory lookup table method. Thus, EMBODIMENT 6 realizes the function of executing the same complicate operations as those realized by EMBODIMENT 5 at lower cost, at higher speed, and with improved operation precision.

Embodiment 7

Figure 21:
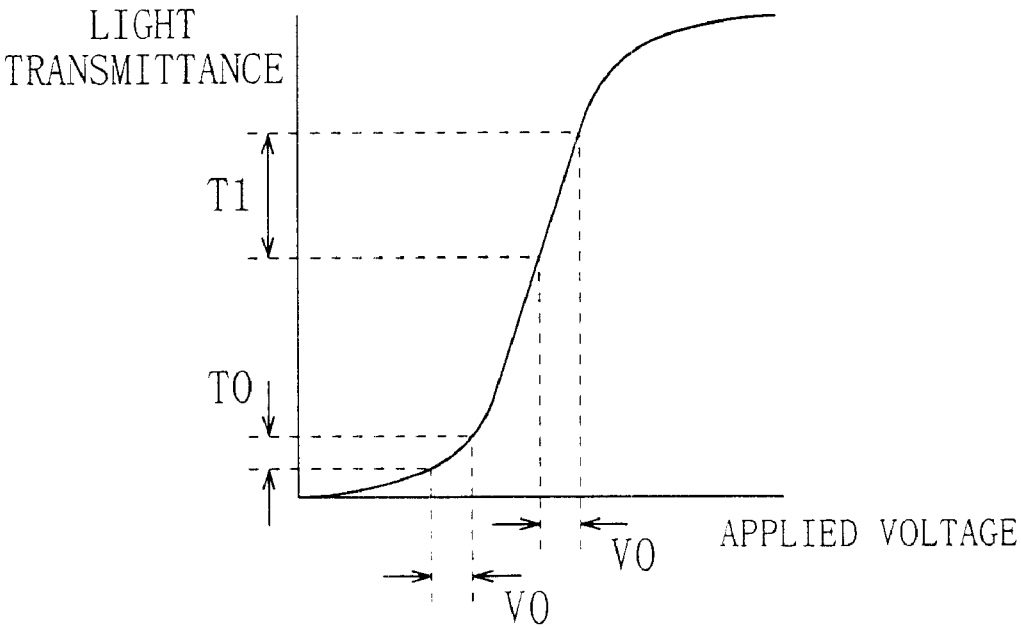
FIG. 21 is a graph showing the relationship between the applied voltage and the light transmittance in EMBODIMENT 7 of the present invention.

In EMBODIMENTS 2 through 6 above, the interference correction was attempted based on the assumption that the characteristics of the display of video data on the plasma addressed display apparatus are linear. This provides sufficient interference correction characteristics. However, in the case where liquid crystal is used as a display medium of the plasma addressed display apparatus, for example, the optical characteristics of liquid crystal with respect to the voltage applied to the data electrode are as shown in FIG. 21. That is, the actual correction amount is different depending on the level of the applied voltage even if the level V0 of the voltage is the same. FIG. 21 is a graph showing the electrooptical characteristics of normally-black mode liquid crystal.

The above electrooptical characteristics can be added to the gain characteristics used in the gain control circuits 609 in EMBODIMENTS 2, 3, and 4 and the gain control circuits 1601 in EMBODIMENTS 5 and 6. With such gain characteristics added, more optimal correction characteristics are obtained. In the case where the gain characteristics are obtained by the memory lookup table method as in EMBODIMENTS 3 and 6, complicate characteristics as shown in FIG. 21 can be implemented without entailing cost increase.

Thus, the present invention provides a matrix display apparatus capable of minimizing interference between video data (interference between pixels in the display state) that otherwise significantly occurs between scanning units (row selection element units).

In the matrix display apparatus of the present invention, the interference between video data can be minimized by performing correction processing for original video data to be displayed, in consideration of the degree of the interference and pixels concerned (the area of pixels interfering each other–the number of pixels and relative positional relationship therebetween). In other words, a cause for possible interference between video data is not removed. Instead, video data is corrected in advance in expectation of an occurrence of interference so that such interference between the video data will not be observed in the actual display state where the interference has occurred. The correction of video data is completed within each row group (including a plurality of continuous scanning units). Therefore, interference between video data can be minimized effectively by comparatively simple correction processing.

In particular, the present invention is suitably applicable to a high-definition plasma addressed display apparatus having a plurality of scanning lines in one plasma discharge channel.

In the plasma addressed display apparatus of the present invention, the correlation between a plurality of scanning lines in one plasma discharge channel can be detected from the difference in amplitude of video data carried by these scanning lines. Based on the detected correlation, lowering of the image quality caused by interference between the scanning lines in one plasma discharge channel is corrected. This makes it possible to realize a high-definition image with improved display quality.

In the plasma addressed display apparatus of the present invention, during detection processing, operations can be executed using only scanning lines allocated in one plasma discharge channel to complete the detection within one plasma discharge channel. This makes it possible to provide optimal correction for interference occurring between scanning lines.

According to the present invention, failure in complete processing of scanning lines within one plasma discharge channel can be avoided by changing the vertical display phase. This prevents disturbance in a display image that may arise when the display image is scrolled upward and downward. In such an occurrence, the phase for realizing complete processing tends to be shifted, causing a problem of using data of scanning lines in different plasma discharge channels for the operation.

Further, according to the present invention, in the gain control of the interference detection correction processing, the operation characteristics are pre-loaded in a memory so that batch operation is possible by the memory lookup table method. With this construction, complicate operations such as multiplication can be made at lower cost, at higher speed, and with improved operation precision.

According to the present invention, the interference detection correction circuit may be provided with the vertical high frequency gain compensation function. Having these two functions of interference compensation and frequency characteristic compensation, the display quality is improved, providing, for example, a character image free of blur or smear at edges.

According to the present invention, the line memories used for the interference detection correction processing can also be used for the vertical high frequency gain compensation processing. This makes it possible to provide the vertical high frequency compensation function for the high-definition plasma display apparatus proposed by the present inventor and co-researchers, with a slight increase in circuit scale, a slight increase in power consumption, and a slight cost increase.

The plasma addressed display apparatus of the present invention may have a construction where the correction amount used in the interference detection correction processing and the gain for the vertical high frequency compensation are cooperative with each other. This prevents breaking of an image due to an excessively large gain given in the vertical high frequency compensation.

The plasma addressed display apparatus of the present invention may have a circuit for reducing a noise component in the determination of the correction amount during the interference detection correction processing. This prevents appearance of an obstruction on the display which otherwise occurs due to a noise component overlapping a video signal.

The plasma addressed display apparatus of the present invention may have a construction of detecting the noise amount of an input video signal and appropriately switching the noise reduction amount used in the circuit for reducing a noise component depending on the detected noise amount. This improves the precision of the noise reduction processing.

According to the present invention, in the gain control of the interference detection correction processing, the operation characteristics and the noise component reduction characteristics are pre-loaded in a memory so that batch operation is possible by the memory lookup table method. With this construction, complicate operations such as multiplication, addition/subtraction, and overflow/underflow can be made at lower cost, at higher speed, and with improved operation precision.

According to the present invention, in the interference detection correction processing, the correction amount is determined in consideration of the electrooptical characteristics of the display cell. This allows for optimal correction.

According to the present invention, the electrooptical characteristics of the display cell are pre-loaded in a memory so that batch operation is possible by the memory lookup table method. With this construction, complicate operations such as multiplication, addition/subtraction, and overflow/underflow can be made at lower cost, at higher speed, and with improved operation precision.

While-the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention which fall within the true spirit and scope of the invention.

What is claimed is:

1. A plasma addressed matrix display apparatus comprising:

a plurality of pixels arranged in a matrix having a plurality of rows and a plurality of columns;

a plurality of row selection elements provided to correspond to the plurality of rows;

a plurality of video signal supply elements provided to correspond to the plurality of columns;

a scanning circuit for supplying a scanning signal sequentially to the plurality of row selection elements for line-sequential scanning of the plurality of pixels for each of the plurality of rows; and a signal generation supply circuit for generating a video signal corresponding to video data to be displayed and supplying the video signal to the plurality of video signal supply elements in synchronization with the line-sequential scanning, wherein a given first pixel of the plurality of pixels belongs to one of a plurality of row groups each having a plurality of continuous rows, and wherein the signal generation supply circuit: (a) receives video data, (b) corrects first video data to be displayed by the first pixel based on a predetermined correction function that includes as variables the first video data and second video data to be displayed by a second pixel belonging to a same row group and a same column as the first pixel and belonging to a row different from the first pixel and depends on the relative positional relationship between at least the first pixel and the second pixel, wherein the first and second pixels are in the same plasma discharge channel so that the first video data is corrected based upon variables relating only to pixel(s) in the same plasma discharge channel in which the first pixel is located, (c) generates a video signal corresponding to the corrected first video data, and (d) supplies the generated video signal to the video signal supply element corresponding to the column to which the first pixel belongs.

2. The matrix display apparatus of claim 1, wherein each of the plurality of row groups includes at least three continuous rows, and the correction function is a predetermined function that further includes as a variable third video data to be displayed by a third pixel belonging to a same row group and a same column as the first pixel and belonging to a row different from the first pixel and the second pixel and further depends on the relative positional relationship between the first pixel and the third pixel.

3. The matrix display apparatus of claim 1, wherein the correction function is a predetermined function that further includes as a variable third video data to be displayed by a third pixel belonging to a same row group as the first pixel, belonging to a column different from the first pixel, and located adjacent to the first or second pixel and further depends on the relative positional relationship between the first pixel and the third pixel.

4. The matrix display apparatus of claim 2, wherein the correction function is a predetermined function that further includes as a variable fourth video data to be displayed by a fourth pixel belonging to a same row group as the first pixel, belonging to a column different from the first pixel, and located adjacent to the first or second pixel and further depends on the relative positional relationship between the first pixel and the fourth pixel.

5. The matrix display apparatus of claim 1, wherein the correction function is a linear function of the first video data and the second video data.

6. The matrix display apparatus of claim 5, wherein a coefficient of the linear function by which the first video data and the second video data are multiplied is predetermined based on brightness characteristics of the plurality of pixels.

7. The matrix display apparatus of claim 1, wherein the signal generation supply circuit includes an interference detection correction circuit, and the interference detection correction circuit executes the correction based on the correction function by an arithmetic operation.

8. The matrix display apparatus of claim 1, wherein the signal generation supply circuit executes the correction based on the correction function by use of a lookup table.

9. A matrix display apparatus comprising:

a plurality of pixels arranged in a matrix having a plurality of rows and a plurality of columns;

a plurality of row selection elements provided to correspond to the plurality of rows;

a plurality of video signal supply elements provided to correspond to the plurality of columns;

a scanning circuit for supplying a scanning signal sequentially to the plurality of row selection elements for line-sequential scanning of the plurality of pixels for each of the plurality of rows;

a signal generation supply circuit for generating a video signal corresponding to video data to be displayed and supplying the video signal to the plurality of video signal supply elements in synchronization with the line-sequential scanning, wherein a given first pixel of the plurality of pixels belongs to one of a plurality of row groups each having a plurality of continuous rows, wherein the signal generation supply circuit: (a) receives video data, (b) corrects first video data to be displayed by the first pixel based on a predetermined correction function that includes as variables the first video data and second video data to be displayed by a second pixel belonging to a same row group and a same column as the first pixel and belonging to a row different from the first pixel and depends on the relative positional relationship between at least the first pixel and the second pixel, (c) generates a video signal corresponding to the corrected first video data, and (d) supplies the generated video signal to the video signal supply element corresponding to the column to which the first pixel belongs; and a plurality of plasma discharge channels each having a plurality of scanning lines running therein, wherein each of the plurality of row groups corresponds to each of the plurality of plasma discharge channels, and each of the plurality of row selection elements corresponds to each of the plurality of scanning lines.

10. A plasma addressed display apparatus comprising:

a panel having a layered structure comprising a plasma cell and a display cell laminated together, the plasma cell including plasma discharge channels arranged in rows each having at least two scanning lines allocated thereto, the display cell including data electrodes arranged in columns, and pixels;

a vertical scanning circuit for effecting scanning of the panel by applying a discharge pulse sequentially to the plasma discharge channels;

a signal circuit for supplying video data to the data electrodes in synchronization with the scanning; and an interference detection correction circuit for detecting correlation between video data for the scanning lines allocated to the same plasma discharge channel and correcting the video data to be supplied to the data electrodes according to the detected correlation.

11. The plasma addressed display apparatus of claim 10, wherein the interference detection correction circuit includes a line memory for accumulating video data for one scanning period required for an operation using video data of adjacent scanning lines so that video data for a given pixel is corrected based only upon variables relating to pixels provided in the same plasma discharge channel.

12. The plasma addressed display apparatus of claim 10, wherein the interference detection correction circuit completes the operation using video data of adjacent scanning lines within the scanning lines allocated to the same plasma discharge channel.

13. The plasma addressed display apparatus of claim 10, wherein the interference detection correction circuit includes a complete control circuit that considers a possible shift of a vertical display position of video data when the video data is displayed on the plasma addressed display apparatus.

14. The plasma addressed display apparatus of claim 10, wherein the interference detection correction circuit determines a correction amount by a lookup table method using a memory so that video data for a given pixel is corrected based only upon variables relating to pixels provided in the same plasma discharge channel.

15. The plasma addressed display apparatus of claim 10, wherein the interference detection correction circuit compensates a vertical high frequency gain of the video data.

16. The plasma addressed display apparatus of claim 15, wherein the interference detection correction circuit accumulates video data for one scanning period required for extracting a vertical high component in the line memory so that video data for a given pixel is corrected based only upon variables relating to pixels provided in the same plasma discharge channel.

17. The plasma addressed display apparatus of claim 15, wherein the interference detection correction circuit sets an optimal gain in cooperation with a gain control circuit for correcting interference.

18. The plasma addressed display apparatus of claim 10, wherein the interference detection correction circuit includes a noise reduction circuit for reducing noise so that video data for a given pixel is corrected based only upon variables relating to pixels provided in the same plasma discharge channel.

19. The plasma addressed display apparatus of claim 18, wherein the noise reduction circuit controls a reduction amount according to a noise level of the video data.

20. The plasma addressed display apparatus of claim 19, wherein the noise reduction circuit stores noise reduction compensation characteristics in a memory.

21. The plasma addressed display apparatus of claim 10, wherein the interference detection correction circuit determines a correction amount in consideration of electrooptical characteristics of the display cell so that video data for a given pixel is corrected based only upon variables relating to pixels provided in the same plasma discharge channel.

22. The plasma addressed display apparatus of claim 10, wherein the interference detection correction circuit stores electrooptical characteristics in memory so that video data for a given pixel is corrected based only upon variables relating to pixels provided in the same plasma discharge channel.

23. A matrix display apparatus comprising:

a plurality of pixels arranged in a matrix having a plurality of rows and a plurality of columns;

a plurality of row selection elements provided to correspond to the plurality of rows;

a plurality of video signal supply elements provided to correspond to the plurality of columns;

a scanning circuit for supplying a scanning signal sequentially to the plurality of row selection elements;

a signal generation supply circuit for generating a video signal(s) corresponding to video data to be displayed and supplying the video signal to the plurality of video signal supply elements, wherein a given first pixel of the plurality of pixels belongs to one of a plurality of row groups each having a plurality of continuous rows, wherein the signal generation supply circuit: (a) receives video data, (b) corrects first video data to be displayed by the first pixel based on a predetermined correction function that includes as variables the first video data and second video data to be displayed by a second pixel belonging to a same row group and a same column as the first pixel and belonging to a row different from the first pixel and depends on the relative positional relationship between at least the first pixel and the second pixel, (c) generates a video signal corresponding to the corrected first video data, and (d) supplies the generated video signal to the video signal supply element corresponding to the column to which the first pixel belongs; and a plurality of plasma discharge channels each having a plurality of scanning lines running therein, wherein each of row group corresponds to one of the plurality of plasma discharge channels.

24. A matrix display apparatus comprising:

a plurality of pixels arranged in a matrix having a plurality of rows and a plurality of columns;

a plurality of row selection elements provided to correspond to the plurality of rows;

a plurality of video signal supply elements provided to correspond to the plurality of columns;

a scanning circuit for supplying a scanning signal sequentially to the plurality of row selection elements for line-sequential scanning of the plurality of pixels for each of the plurality of rows; and a signal generation supply circuit for generating a video signal corresponding to video data to be displayed and supplying the video signal to the plurality of video signal supply elements in synchronization with the line-sequential scanning, wherein a given first pixel of the plurality of pixels belongs to one of a plurality of row groups each having a plurality of continuous rows, and wherein the signal generation supply circuit: (a) receives video data, (b) corrects first video data to be displayed by the first pixel based on a predetermined correction function that includes as variables the first video data and second video data to be displayed by a second pixel belonging to a same row group and a same column as the first pixel and belonging to a row different from the first pixel and depends on the relative positional relationship between at least the first pixel and the second pixel, so that the first video data is corrected based upon variables relating only to pixel(s) in the same row group in which the first pixel is located, (c) generates a video signal corresponding to the corrected first video data, and (d) supplies the generated video signal to the video signal supply element corresponding to the column to which the first pixel belongs.

25. A matrix display apparatus comprising:

a plurality of pixels arranged in a matrix having a plurality of rows and a plurality of columns;

a plurality of row selection elements provided to correspond to the plurality of rows;

a plurality of video signal supply elements provided to correspond to the plurality of columns;

a scanning circuit for supplying a scanning signal sequentially to the plurality of row selection elements for line-sequential scanning of the plurality of pixels for each of the plurality of rows; and a signal generation supply circuit for generating a video signal corresponding to video data to be displayed and supplying the video signal to the plurality of video signal supply elements in synchronization with the line-sequential scanning, wherein a given first pixel of the plurality of pixels belongs to one of a plurality of row groups each having a plurality of continuous rows, and wherein the signal generation supply circuit: (a) receives video data, (b) corrects first video data to be displayed by the first pixel based on a predetermined correction function that includes as variables the first video data and second video data to be displayed by a second pixel belonging to a same row group and a same column as the first pixel and belonging to a row different from the first pixel and depends on the relative positional relationship between at least the first pixel and the second pixel, wherein correction of the first video data is completed within the row group in which the first pixel is located, (c) generates a video signal corresponding to the corrected first video data, and (d) supplies the generated video signal to the video signal supply element corresponding to the column to which the first pixel belongs.

* * * * *

UNITED STATES PATENT AND TRADEMARK OFFICE

CERTIFICATE OF CORRECTION

PATENT NO. : 6,489,938 B1
APPLICATION NO. : 09/551574
DATED : December 3, 2002
INVENTOR(S) : ITO It is certified that error appears in the above-identified patent and that said Letters Patent is hereby corrected as shown below:

Delete Fig. 17 and Replace with attached corrected Figure 17.

Signed and Sealed this

Twenty-first Day of November, 2006

JON W. DUDAS
*Director of the United States Patent and Trademark Office*